US011779828B1

(12) United States Patent
Jacobi

(10) Patent No.: US 11,779,828 B1
(45) **Date of Patent: *Oct. 10, 2023**

(54) SNOWBOARD BINDING AND SNOWBOARD

(71) Applicant: Timothy Robert Jacobi, Durham, NC (US)

(72) Inventor: Timothy Robert Jacobi, Durham, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/099,381

(22) Filed: Jan. 20, 2023

Related U.S. Application Data

(63) Continuation-in-part of application No. 17/844,923, filed on Jun. 21, 2022.

(51) Int. Cl.

| | |
|---|---|
| ***A63C 10/20*** | (2012.01) |
| ***A63C 10/08*** | (2012.01) |
| ***A63C 5/03*** | (2006.01) |
| ***A63C 10/14*** | (2012.01) |

(52) U.S. Cl.
CPC ..... *A63C 10/08* (2013.01); *A63C 5/03* (2013.01); *A63C 10/145* (2013.01)

(58) Field of Classification Search
CPC ..... A63C 10/02; A63C 10/08; A63C 10/16; A63C 10/20; A63C 10/145; A63C 5/03
See application file for complete search history.

(56) References Cited

U.S. PATENT DOCUMENTS

| | | | | |
|---|---|---|---|---|
| 5,813,689 | A * | 9/1998 | Mansure | A63C 10/04 280/14.22 |
| 5,855,390 | A * | 1/1999 | Hassell | A63C 10/28 280/607 |
| 6,142,503 | A * | 11/2000 | Forest | A63C 10/28 280/624 |
| 8,322,730 | B2 * | 12/2012 | Sorenson | A63C 10/28 280/14.22 |
| 2009/0289439 | A1 * | 11/2009 | Carpenter | A63C 10/26 280/618 |
| 2010/0109289 | A1 * | 5/2010 | Wischhusen | A63C 10/14 280/613 |
| 2019/0160364 | A1 * | 5/2019 | Walsh | A63C 10/14 |
| 2021/0146229 | A1 * | 5/2021 | Lee | A63C 7/1013 |
| 2023/0022873 | A1 * | 1/2023 | Goldenring | A63C 10/28 |

OTHER PUBLICATIONS

Updated filing receipt of parent U.S. Appl. No. 17/844,923, filed Jun. 21, 2022.

* cited by examiner

*Primary Examiner* — Brian L Swenson

(57) ABSTRACT

The invention concerns a snowboard binding (1) comprising a snowboard anchor element (2) and a boot anchor element (3); at least one pivot mechanism (4) pivotally coupling the snowboard anchor element (2) and the boot anchor element (3) to allow pivoting of the boot anchor element (3) with respect to the snowboard anchor element (2). It also concerns a snowboard adapted for this binding.

19 Claims, 19 Drawing Sheets

SNOWBOARD BINDING AND SNOWBOARD

This application is a Continuation-in-part of U.S. Ser. No. 17/844,923 filed Jun. 21, 2022 incorporated herein by reference in its entirety.

FIELD OF THE INVENTION

The present disclosure relates to a binding for holding a boot securely attached to a snowboard as well as to a snowboard suitable for improving fun and entertainment when using said snowboard binding.

STATE OF THE ART

Snowboarding is an activity and sport enjoyed throughout the world. The equipment used for snowboarding includes a snowboard, snowboard boots and snowboard bindings mounted on the snowboard and used to secure the snowboarding boots worn by a snowboarder.

The snowboard bindings create a direct connection to the snowboard and their task is to transfer energy of the rider's body and his/her muscle movements to the snowboard to help the rider to control his/her board. The bindings are a key component of the snowboard and can enhance the riding experience or ruin it if a wrong binding is used. When choosing the bindings, a rider has to consider his riding style and preferences.

The most of the known snowboard binding designs provide a stiff connection between the boot and the snowboard thereby making it uncomfortable to ride. The common soft binding is also uncomfortable on the ski lift.

U.S. Pat. No. 5,855,390 discloses a laterally flexible snowboard binding system that enables the rider to have good rotation of the body toward the front of the board. The snowboard binding system comprises a snowboard anchor plate, a boot anchor plate, a biasing unit and a locking unit. The snowboard anchor plate is attached on one side to the biasing unit and on the other side to the locking unit. The biasing unit is made up of a hinge and coil spring. The locking unit is releasable by the snowboard rider for maintaining the snowboard anchor plate and the boot anchor plate in a substantially parallel relationship, except when the locking means is released by the snowboard rider. This snowboard binding provides a certain freedom for the rider with respect to the board and allows the rider to adjust the pitch of the binding so that the front and rear legs are more parallel with the snowboard.

This known pivoting snowboard binding has the pivot, i.e. the biasing unit, at the level of the top of the board to the side of the foot. The mechanism cannot support weight and also rotate. Furthermore, the existing pivot works in an on/off mode such that the pivot is only active during jumps or on the ski lift. Most of the time it acts like a normal snowboard without any pivoting means. Since the pivot is provided on the side of the foot, the pivot does not provide a natural rotation point thus it is uncomfortable. In addition, the pivot of this known snowboard binding allows the rotation of only one foot at a time due to the nature of the hinges on the outside of each foot. Additionally it allows movement of the leg only in one direction off of vertical.

Another drawback of the known traditional bindings is that in case of riding in deep powder snow, the rider must lean back and it is tiring on the rear leg.

Therefore, it is an object of the present invention to overcome the problems of the known snowboard bindings and to provide a new snowboard binding with increased freedom of movement of the boot anchor plate with respect to the snowboard anchor plate and to the body of the snowboard.

A further object of the present invention is to provide a snowboard binding with a comfortable tilting of the rider's feet that allows the rider to carry out different snowboarding tricks as well as an easy riding in deep powder snow.

It is a further object of the present invention to provide a snowboard binding that allows tilting of both feet of the rider with this rotation always being available. This allows the rider to always have a most natural foot position and achieve body positions with respect to the board not possible with traditional bindings.

It is a further object of the present invention to provide an adapted snowboard which is suitable for the snowboard binding of the present invention to allow for more tricks and create a different way to ride a snowboard.

These and other objects are achieved by the snowboard binding according to the present invention.

SUMMARY OF THE INVENTION

The present invention provides a snowboard binding with a boot anchor element which is pivotably (rotationally) arranged with respect to the snowboard anchor plate and the body of the snowboard. In a first aspect of the present invention, a snowboard binding comprises a snowboard anchor element, a boot anchor element and at least one pivot mechanism. The boot anchor element is pivotally connected to the snowboard anchor element. The at least one pivot mechanism comprises least one pivot and/or at least one sliding guide.

According to an aspect of the present invention, the snowboard binding comprises two pivot mechanisms pivotally coupling both to the snowboard anchor element and the boot anchor element to allow pivoting of the boot anchor element with respect to the snowboard anchor element. In particular, according to an aspect of the invention, the snowboard anchor element and the boot anchor element are pivotally connected at their respective front and/or rear portions by means of the pivot mechanism to suspend the boot anchor element at its front and rear portions with respect to the snowboard anchor element.

It has to be noted that the terms "front portion" and "rear portion" are used herein to indicate portions of the snowboard anchor element and/or of a boot anchor element that in use are in the direction the foot of the user is pointing. In other words, the front portion is substantially the area where in use the toes of the user are arranged, while the rear portion is substantially the area where in use the heel of the user is arranged.

The terms "to pivot", "pivot mechanism", "pivoting" and "pivotally" are used herein to also refer to "rotate" or "swivel" or tilt", which words are suitable to describe a turning or revolving movement around a pivot or rotation axis.

In other words, according to the present disclosure, for example the wording "at least one pivot mechanism pivotally coupling a snowboard anchor element and a boot anchor element" is used herein also with the meaning of "at least one tilting mechanism rotationally coupling a snowboard anchor element and a boot anchor element".

It has to be noted that the pivot or rotation axis can be a real axis or an imaginary axis. For example, as discussed in greater detail here below, in the embodiment shown in FIGS. 1-9 the pivot or rotation axis is provided by two pivots (e.g. comprising a shaft or pin and a nut) arranged substantially at both the rear and front portion of the binding. It has to be noted that according to an aspect the rotation or pivot axis passes through the at least one pivot.

Additionally, according to possible embodiments, the pivot mechanism comprises one or more sliding guide intended to provide a rotation about a pivot or rotation axis, that in this case is an imaginary pivot or rotation axis, defined for example by the curvature of the sliding guide.

In the embodiment shown in FIGS. 10-16, the pivot mechanism comprises a pivot (e.g. comprising a shaft or pin and a nut) substantially at the rear portion of the binding thus providing a real pivot or rotation axis, and also comprises a sliding guide intended to provide a rotation about a pivot or rotation axis, that in this case is an imaginary pivot or rotation axis, defined for example by the curvature of the sliding guide. In this embodiment the pivot or rotation axis of the pivot at the rear portion of the binding (that is a real pivot or rotation axis) corresponds to the pivot or rotation axis of the sliding guide (that is an imaginary rotation axis).

It has to be also noted that, even if not shown in the figures, embodiments wherein the pivot mechanism comprises two sliding guides (without pivot), e.g. the pivot at the rear portion of the embodiment of FIGS. 10-16 is replaced by another sliding guide, are also possible and fall within the scope of the present invention. In this case, the two or more sliding guides provides a pivot or rotation axis that is an imaginary rotation axis.

Advantageously, the presence of at least one pivot mechanism, preferably at least two pivot mechanisms, allow tilting (rotational) movement of the feet of the rider, preferably above the plane of the snowboard. According to an aspect, the snowboard binding of the present invention has two pivot mechanisms at the height of the ankle, or close to the height of the ankle, preferably with a horizontal axis of rotation in the direction of the foot is pointing.

According to another aspect of the present invention, the snowboard anchor element comprises a bottom plate, i.e., it is provided with a bottom surface, at least partially or preferably completely flat, that can be arranged on the flat surface of the snowboard. According to an embodiment the snowboard anchor element comprises two side walls in its longitudinal direction. Advantageously, each of the side walls are bent upwards at their front and rear extremities in a manner to join said side walls at the respective front and rear portions.

According to an embodiment, the side walls of the snowboard anchor element is tapered to end in respective front and rear portions.

According to an aspect each of said front and rear portions of the cage-like shaped or shell-shaped snowboard anchor element has a through-hole for accommodating the pivot mechanism to connect the snowboard anchor element with the boot anchor element.

According to an aspect the boot anchor element has front and rear portions and each of them is provided with a through-hole for accommodating therein a pivot mechanism and to pivotally connect the boot anchor element to the snowboard anchor element.

According to an aspect of the present invention, both the snowboard anchor element and the boot anchor element have a substantially cage-like shape or they are substantially shell-shaped. In particular, the front and/or rear portion of the snowboard anchor element and of the boot anchor element has a substantially cage-like shape or is substantially shell shaped.

The term "substantially cage-like" shape is used in the present disclosure to describe an open work structure, which has a hollow or concave shape. The term substantially shell-shaped also refers to a hollow and concave shape.

The at least one pivot mechanism, preferably the at least two pivot mechanisms, comprise a pivot (rotation) axis allowing rotation of the boot anchor element with respect to the snowboard anchor element that is arranged at a distance from the bottom of the binding, preferably from the bottom plate of the snowboard anchor element. This distance is such that it enables the boot anchor element to swing, preferably freely swing, around the pivot axis and above the side walls of the snowboard anchor element.

According to an aspect, the pivot or rotation axis is arranged close to the rider's ankle height and preferably along the direction of the rider's foot.

According to an aspect the pivot or rotation axis is arranged within the width of the binding, preferably within the width of the rider's foot. Advantageously, this position of the pivot or rotation axis, that is not arranged outside the width of the binding (preferably is not arranged outside the width of the rider's foot), allows tilting (rotational) movement of the feet of the rider, preferably above the plane of the snowboard.

According to an aspect, the pivot axis of the pivot mechanisms is preferably parallel or only slightly inclined with respect to the bottom plate of the snowboard anchor element.

It has to be noted that the term "slightly inclined" is used herein to indicate that the pivot axis of the pivot mechanism may be inclined with an angle up to 5° or preferably less than 3° with respect to the bottom plate of the snowboard anchor element.

Furthermore, according to an aspect, the pivot axis of the pivot mechanism passes through the front and rear portions both of the boot anchor element and snowboard anchor element. In particular, the two pivot mechanisms comprise two pivots: a pivot that passes through through-holes formed on the respective front portions, i.e., front extremities, of the snowboard anchor element and boot anchor element as well as another pivot passing through holes formed on the respective rear portions, i.e., rear extremities, of the snowboard anchor element and boot anchor element.

According to an aspect, the boot anchor element comprises a heel holder, a bottom plate and side walls. The heel holder may be integral with the boot anchor element or may be attached thereto. The heel holder fits around the boot of the snowboarder above the point where it expands for the heel of a foot. According to an embodiment, the heel holder protrudes upwardly from the rear portion of the boot anchor element.

The bottom plate of the snowboard anchor element has an inner surface and an outer surface, wherein the inner surface refers to the surface that faces toward the bottom plate of the boot anchor element, while the outer surface of the bottom plate indicates the surface that faces toward the snowboard once the snowboard binding is attached thereto.

The bottom plate of the boot anchor element has an inner surface and an outer surface, wherein the inner surface indicates the surface on which the user's boot will rest, while the outer surface indicates the surface of the bottom plate that faces toward the inner surface of the bottom plate of the snowboard anchor element.

According to another aspect, the boot anchor element, preferably on the outer surface of its bottom plate, is provided with at least one transversally protruding element that can be engaged with a sliding guide provided transversally on the snowboard anchor element (preferably on the inner surface of its bottom plate), or vice versa the boot anchor element is provided with at least one sliding guide and the snowboard anchor element is provided with at least one transversally protruding element cooperating with the sliding guide. Said sliding guide has such a shape, preferably a complementary shape with said protruding element, that allows a free sliding of said transversally protruding element of the boot anchor element in said guide of the snowboard anchor element.

According to possible embodiments, wherein more than one sliding guides are provided each of said sliding guides interacts with a corresponding element, preferably transversally protruding from the outer surface of the bottom plate of the boot anchor element, or vice versa.

In a further aspect of the present invention said at least one pivot mechanism comprises one pivot and at least one sliding guide.

According to an embodiment, said one pivot passes through at least one hole formed on the rear portion of the snowboard anchor element and on the rear portion of the boot anchor element, and said at least one sliding guide is provided on the snowboard anchor element and interacts with said element that transversally protrudes from the outer surface of the bottom plate of the boot anchor element in order to allow a pivot coupling between the boot anchor element and the snowboard anchor element.

In an exemplary embodiment the snowboard anchor element may comprise one sliding guide substantially at the front portion and another sliding guide at the rear portion of the snowboard anchor element, and, accordingly, two corresponding protruding elements that transversally protrudes from the front portion and rear portion of the outer surface of the bottom plate of the boot anchor element.

According to another aspect of the present invention, the snowboard binding comprises a pivot at the rear portion of both the boot anchor element and the snowboard anchor element, and a sliding guide at least at the front portion of the snowboard anchor element. Preferably, there are sliding guides both at the front and rear portions of the outer surface of the bottom wall of the snowboard anchor element.

When the snowboard binding comprises one pivot rotatably connecting the rear portion of both the boot anchor element and the snowboard anchor element, the substantially cage-like shape or substantially shell shape of the snowboard anchor element and the boot anchor element is open at the front portion, preferably the front portion of the bottom plate of the snowboard anchor element and/or the front portion of the bottom plate of the boot anchor element is freely exposed.

This construction of the snowboard binding allows for different boot sizes to be inserted. In addition, in this embodiment of the invention the pivot point is at the rear portion of both the boot anchor element and the snowboard anchor element while allowing to provide a sliding connection at the front portions between the boot anchor element and the snowboard anchor element, thus cooperating also at the front portion in pivotally coupling the boot anchor element and the snowboard anchor element. In particular, there is a capture feature, such as for example a sliding guide having a substantially "L-shaped" cross section, which supports the front of the boot anchor element in the vertical and horizontal directions while still allowing sliding around the rotation axis.

This embodiment of the present invention, wherein the at least one pivot mechanism comprises a pivot in combination with at least one sliding guide, provides a larger range of boot sizes accommodated by the binding.

Preferably, said protruding elements of the boot anchor element have a shape complementary to the shape of the corresponding sliding guide, provided on the snowboard anchor element, in order to allow free rotation of the boot anchor element around the rotation axis of the snowboard binding.

As mentioned, according to possible embodiments, it is not excluded that the protruding elements is provided on the snowboard anchor element and the sliding guide is arranged on the boot anchor element.

In a preferred embodiment of the present invention the sliding guide has the shape of a channel, i.e., it has a bottom wall and two side walls which form a cavity wherein the protruding element of the boot anchor element can freely slide due to its complementary shape. Thereby the sliding guide controls the direction of the movement of the boot anchor element within the snowboard anchor element.

According to an embodiment, the snowboard binding comprises two sliding guides and two protruding elements, wherein said protruding elements have a shape complementary to the shape of the corresponding sliding guide.

According to an aspect, the rider's boot can be attached to the boot anchor element by means of fastening methods known in the art, such as binding or ratcheting straps, laces, clips, step-in systems, etc. Any fastening means can be used for this scope in addition to or in place of the herein mentioned fastening means. According to an aspect of the present invention, the fastening means can be attached to the boot anchor element by connecting apertures, preferably by being bolted through holes. Advantageously, the connecting apertures or through holes are provided on the side walls and/or on the heel holder of the boot anchor element.

In another aspect of the present invention, the snowboard anchor element, and preferably its bottom plate, is provided with an angle set plate having slots or holes or bores for fixing the angle set plate to the snowboard, e.g., by screws, bolts, etc., as is known in the art. Preferably, the angle set plate is arranged in the plane of the bottom plate of the snowboard anchor element. The angle set plate may also be attached to the snowboard by means of a traditional toothed disk and screws.

Advantageously, the angle set plate is connected to the snowboard anchor element by means of an elastic element, such as springs or an elastomer. The angle set plate having this element allows a stiff and limited rotation about a vertical axis located in the middle of the foot when the rider is wearing the snowboard binding of the present invention, but it does not allow translation of the set plat relative to the board.

A further aspect of the present invention is a snowboard, preferably for attaching a snowboard binding of the present invention. The board has a longitudinal shape with a length and width such to allow the fixing of a pair of said binding on its longitudinal upper surface.

The longitudinal upper surface terminates in a tip and a tail. The tip and/or the tail are upwards bent at an angle comprised between 30° and 80° with respect to the upper longitudinal surface of the snowboard.

The bent tip and/or tail portions of the board should preferably have a length such to allow the rider to exploit the advantageous of the snowboard binding of the present invention and to do many tricks, which are not implementable by the known snowboard bindings. In particular, with the tilting of the binding and the bent sections on the tip and tail of the board, the rider is able to ride stably on the tip or tail of the board. This length preferably has a flat portion but it may also have a continual curve.

It is possible for only the tip or only the tail to be bent upwards, while the other side may resemble a traditional snowboard.

The tip or tail may have a handle which the rider may hold when riding the board in the inclined position.

Advantageously, the length of each of the bent tip and bent tail is comprised between 50 mm and 800 mm (preferably between 50 mm and 700 mm) determined for the entire length of a snowboard comprised between 1000 mm and 2000 mm.

The ratio between the length of each of said bent tip or bent tail with respect to the entire length of the snowboard is comprised between 1/20 and 1/3.

This arrangement of the snowboard binding permits the rider to be more comfortable with respect to known bindings and do more interesting tricks.

BRIEF DESCRIPTION OF THE FIGURES

The structure and characteristics of the snowboard binding of the present invention will be more apparent from the ensuing description of a preferred embodiment thereof given with reference to the accompanying drawings, in which.

DETAILED DESCRIPTION OF THE DRAWINGS

Figure 1:
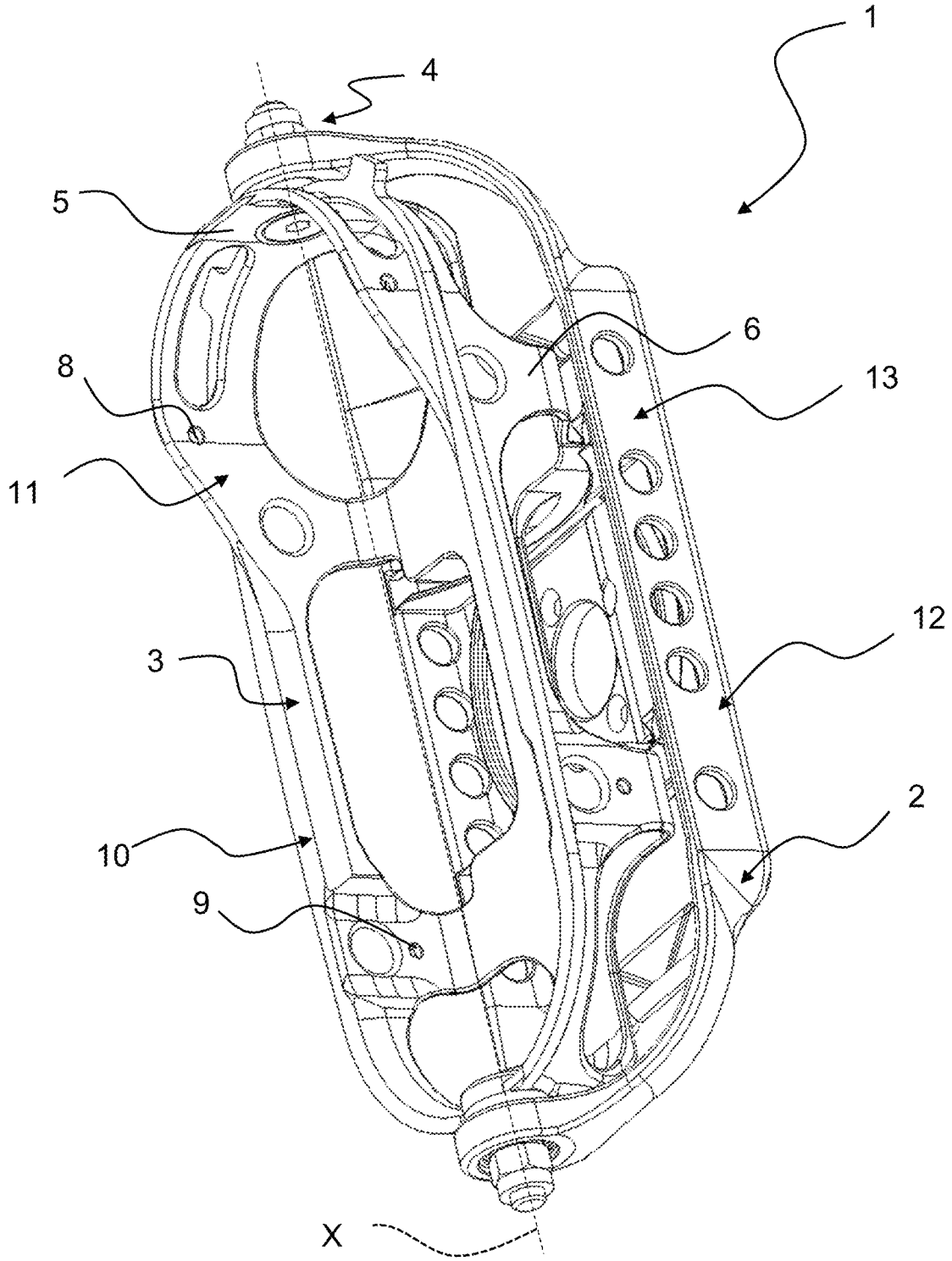
FIGS. 1 and 2 are schematic perspective view of a possible embodiment of the snowboard binding according to the present invention wherein the boot anchor plate is not pivoted with respect to the snowboard anchor element.

Described herein is a snowboard binding configured to secure a rider to a snowboard, which allows the rider to transfer torques and forces from his or her legs to the snowboard in order to control the snowboard and/or to provide comfortable riding stances. In addition, the snowboard binding of the present invention is configured to allow a snowboarder to transfer a variety of his or her leg/foot movements to the snowboard for the generation of a range of varying torque forces to the snowboard thereby providing a snowboarder with greater flexibility of his or her body with respect to the board.

Accordingly, the snowboard binding of the present invention provides a mobility relative to the board and allows the rider to adjust his or her foot position relative to the snowboard because the binding is configured to pivot relative to the snowboard. This allows the rider to assume a comfortable riding stance.

FIGS. 1-9 show a possible embodiment of the snowboard binding of the present invention. The illustrated snowboard binding (1) (also referred to herein as the binding) comprises a snowboard anchor element (2), a boot anchor element (3) and two pivots (19, 20).

The snowboard anchor element (2) is pivotally connected to the boot anchor element (3) by means of the pivot mechanisms comprising two pivots or pivot (rotational) joints (19, 20). This arrangement of the binding (1) allows pivoting or tilting of the boot anchor element (3) with respect to the snowboard anchor element (2), as for example shown in FIGS. 3, 4 and 9.

In particular, the snowboard anchor element (2) and the boot anchor element (3) are pivotally connected at their respective front and rear portions (10, 11, 12, 13) by means of the two pivots, i.e., two pivoting joints used as pivot mechanisms.

In particular, the illustrated snowboard binding (1) comprises a pivot mechanism including two pivots (19, 20). The pivot axis of said mechanism passes through holes in the respective front portions (10, 12) of the snowboard anchor element (2) and boot anchor element (3) as well as through holes in the respective rear portions (11, 13) of the snowboard anchor element (2) and boot anchor element (3).

This arrangement of the two pivots (19, 20) in the snowboard binding of the present invention allow suspension of the boot anchor element (3) at two pivot points (19, 20), i.e. at its front (10, 12) and rear portions (11, 13) with respect to the snowboard anchor element (2).

According to a possible embodiment, as for example shown in the attached figures, the snowboard anchor element (2) comprises a bottom plate (14) and two side walls (15) in the longitudinal direction of the snowboard anchor element (12). The boot anchor element (3) is formed by a bottom plate (7), side walls (6) and a heel holder (6).

The bottom plate (14) of the snowboard anchor element (2) has an inner surface and an outer surface, wherein the inner surface refers to the surface that faces toward the bottom plate (7) of the boot anchor element (3), while the outer surface of the bottom plate (14) indicates the surface that faces toward the snowboard once the snowboard binding is attached thereto.

The bottom plate (7) of the boot anchor element (3) has an inner surface and an outer surface, wherein the inner surface indicates the surface on which the user's boot will rest, while the outer surface indicates the surface of the bottom plate (7) that faces toward the inner surface of the bottom plate (14) of the snowboard anchor element (2).

According to an embodiment, as for example shown in the illustrated embodiment, the pivot (20), and thus also its rotation axis X, passes through a hole formed in the rear portion (11) of the boot anchor element (3) thus the snowboard binding (1) has a pivot (20) which is located at the height, or close to the height, of the ankle of the rider with a horizontal axis of rotation in the direction of the foot is pointing.

Both the snowboard anchor element (2) and the boot anchor element (3) are made preferably from a strong plastic or light metal and comprise recesses in order to reduce the weight of the binding.

The two pivot mechanisms (4), including two pivots (19, 20), comprise a pivot axis (X) allowing rotation or tilting of the boot anchor element (3) with respect to the snowboard anchor element (2). The pivot or rotation axis (X) is arranged at a distance from the bottom plate (14) of the snowboard element (2) that allows the tilting/swinging, preferably a free tilting/swinging, of the boot anchor element (3) with respect to the snowboard anchor element (2), preferably above the edge of the side walls (15) of the snowboard anchor plate (2).

In the embodiment shown in the FIGS. 1-9, the pivot axis (X) connects the through holes formed on the front and rear portions (10, 11, 12, 13) of the respective snowboard anchor element (2) and boot anchor element (3).

The illustrated embodiment of FIGS. 1-9 shows that each pivot mechanism (4) is formed by a pivot comprising a shaft or pin and a nut. Other types of pivots are equally suitable for obtaining the same result. One or more bearing(s), preferably ball bearing(s), can be provided at the pivot.

Figure 2:
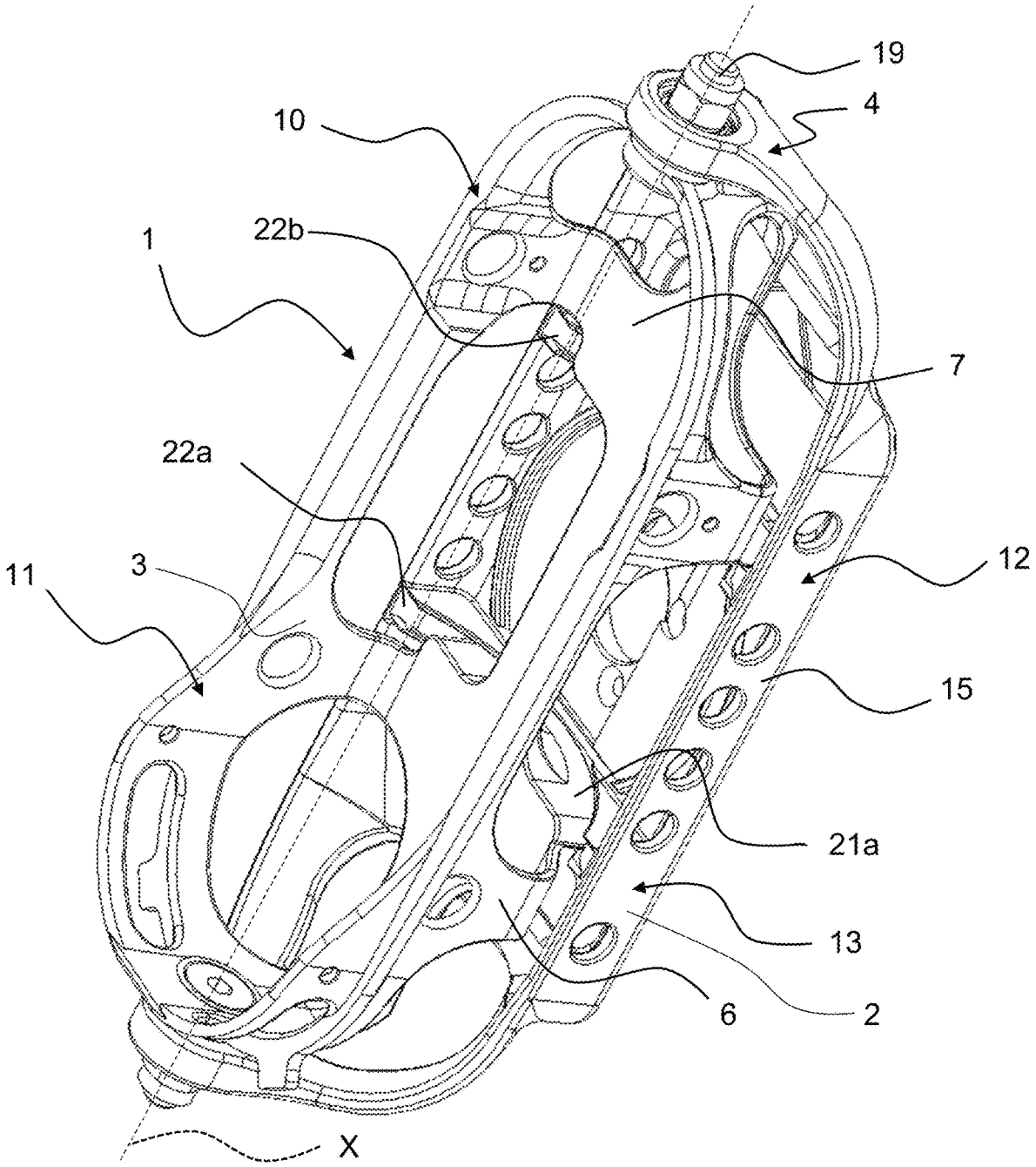
Figure 3:
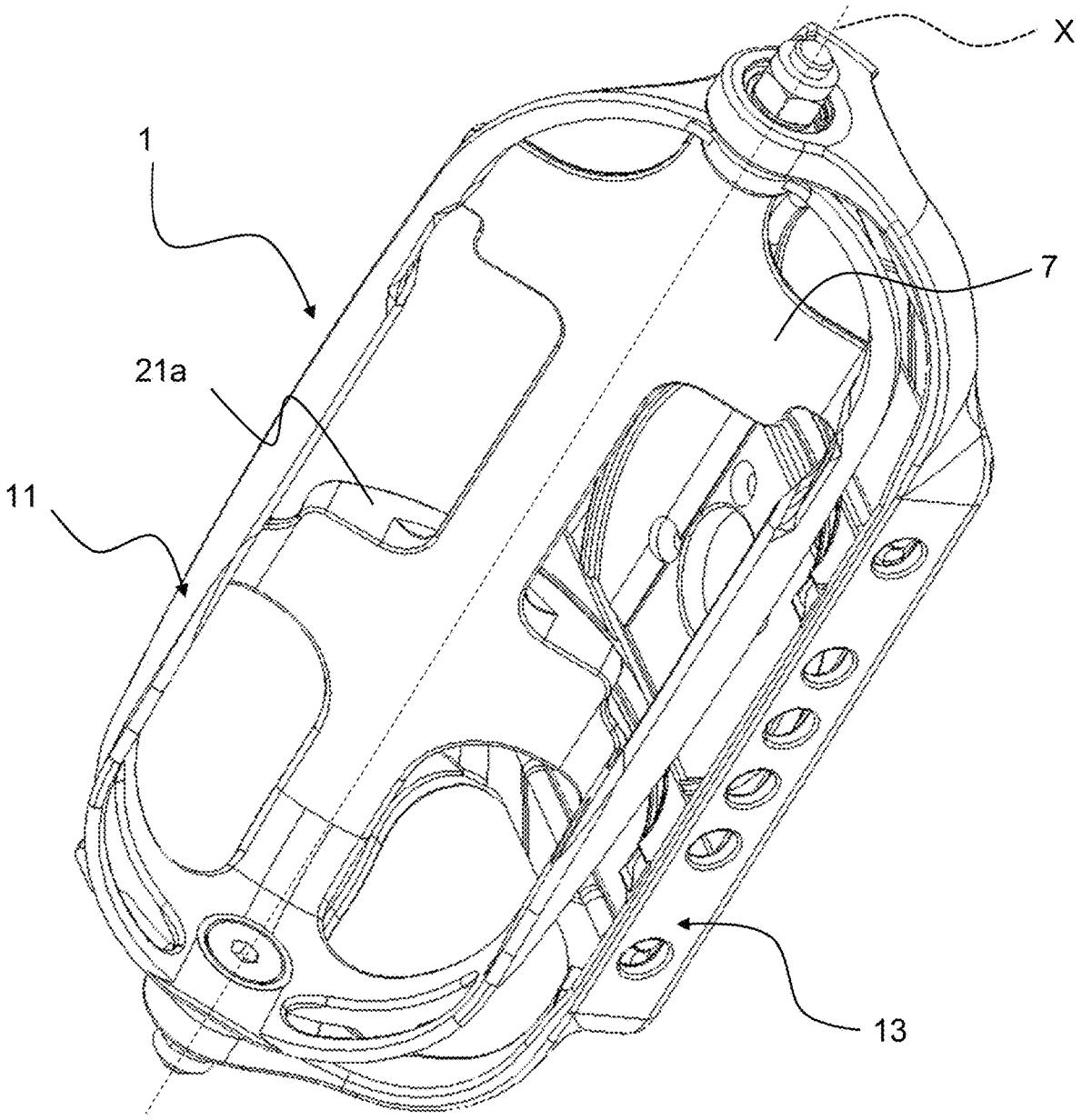
FIGS. 3 and 4 are schematic perspective view of a possible embodiment of the snowboard binding according to the present invention wherein the boot anchor plate is pivoted with respect to the snowboard anchor element.
Figure 4:
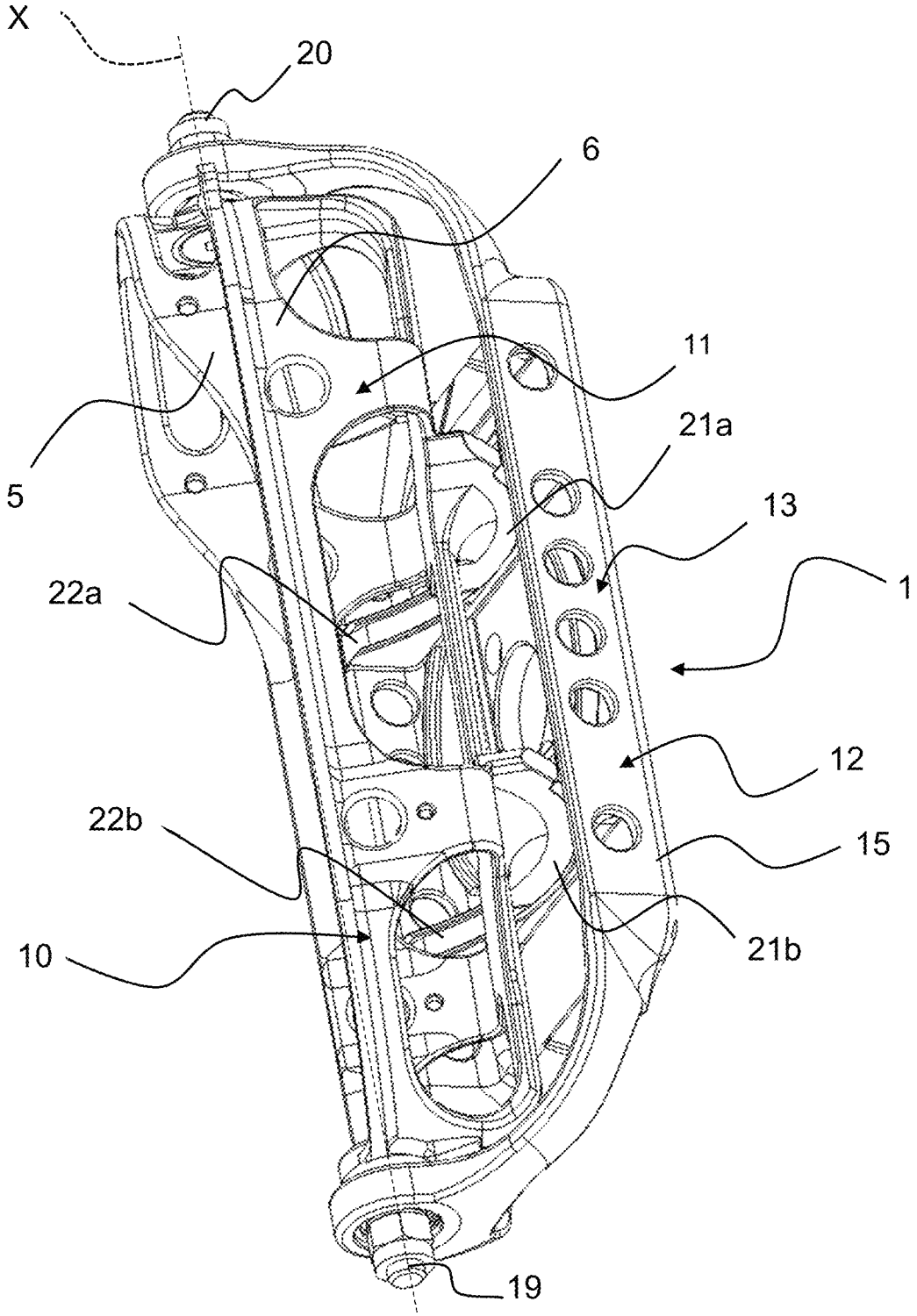
Figure 5:
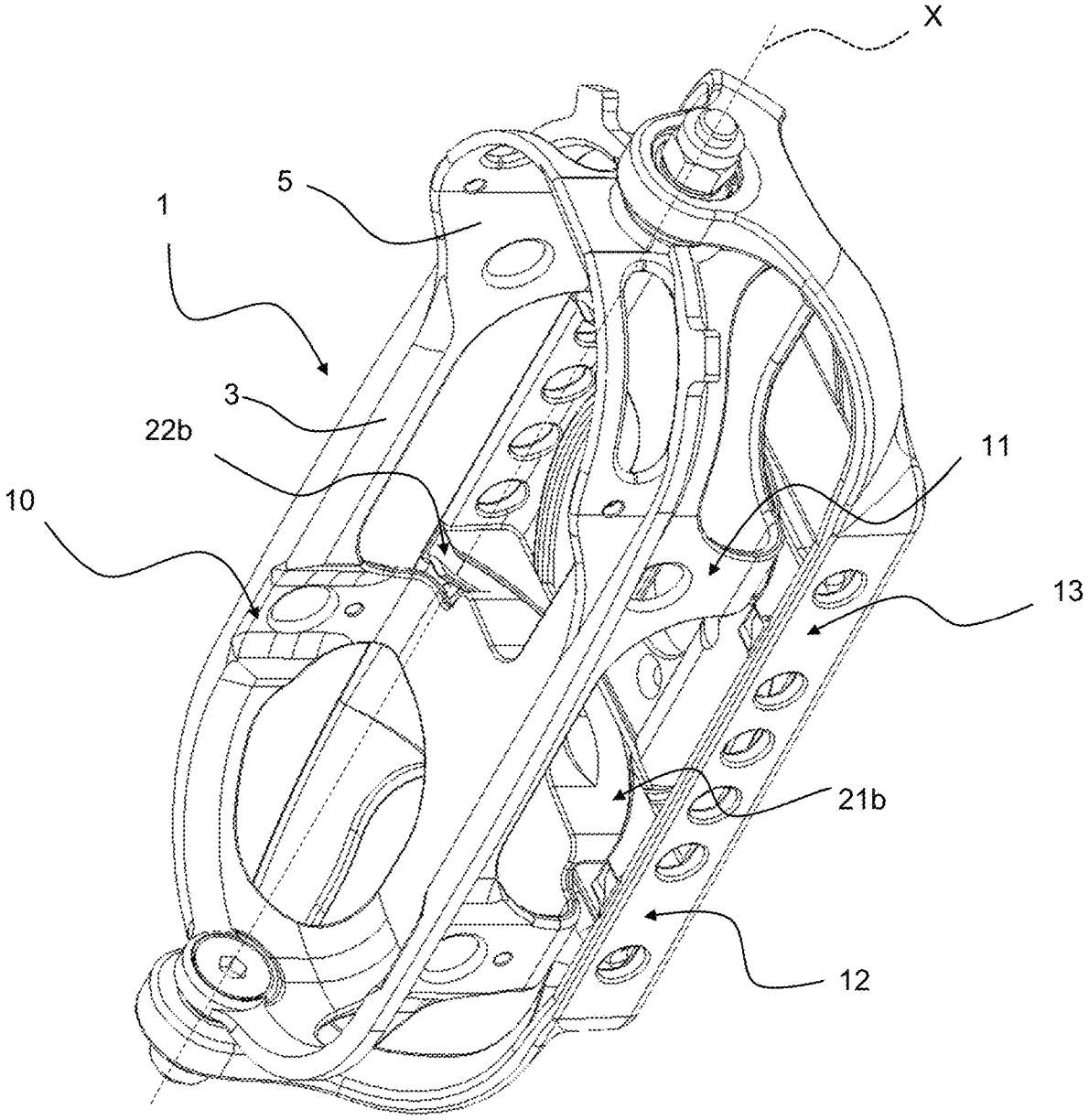
FIG. 5 is a schematic perspective rear view of a possible embodiment of the snowboard binding according to the present invention.
Figure 6:
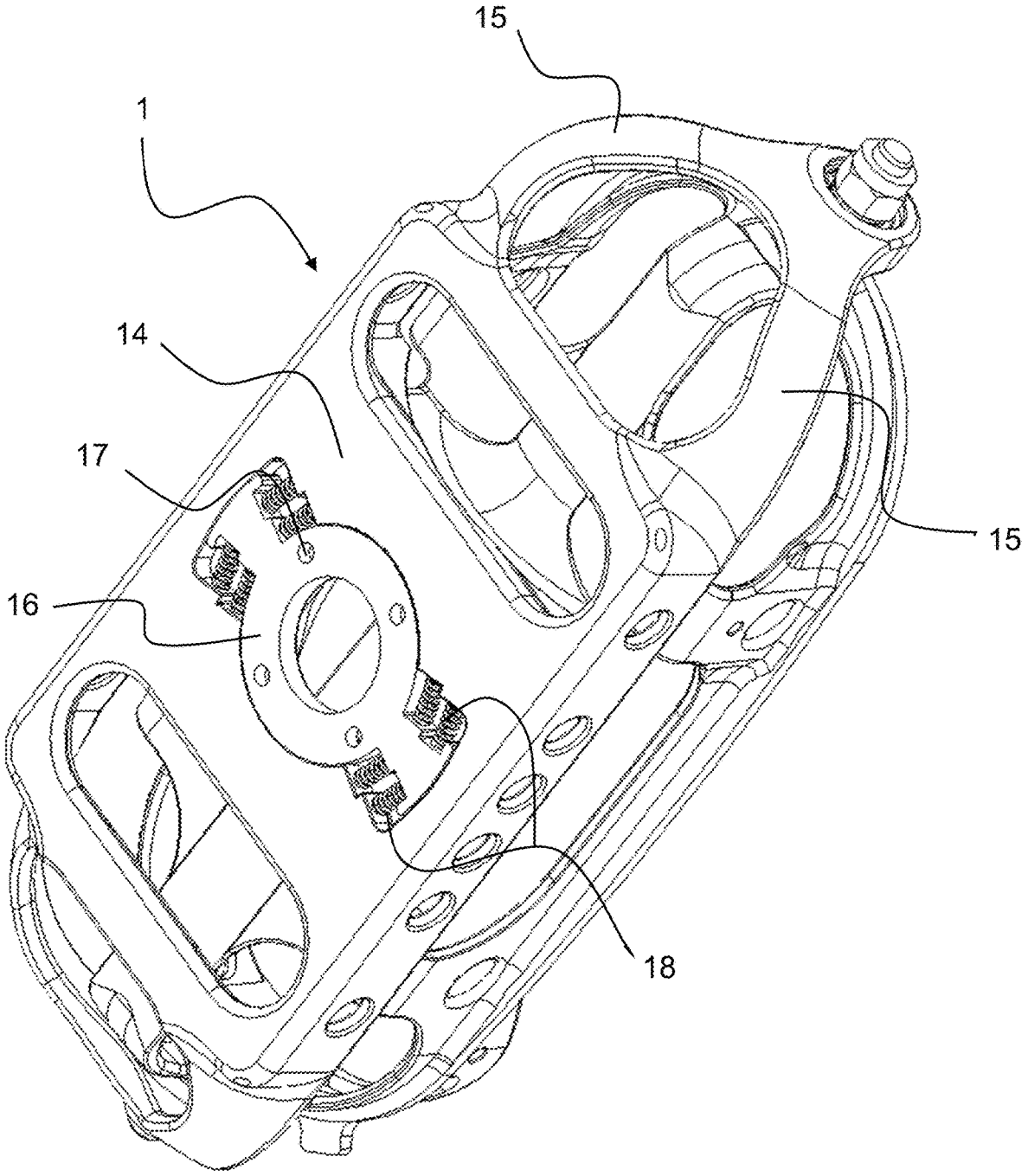
FIGS. 6 and 7 are schematic perspective rear views of a possible embodiment of the snowboard binding of showing the binding from the bottom wall of the snowboard anchor element.
Figure 7:
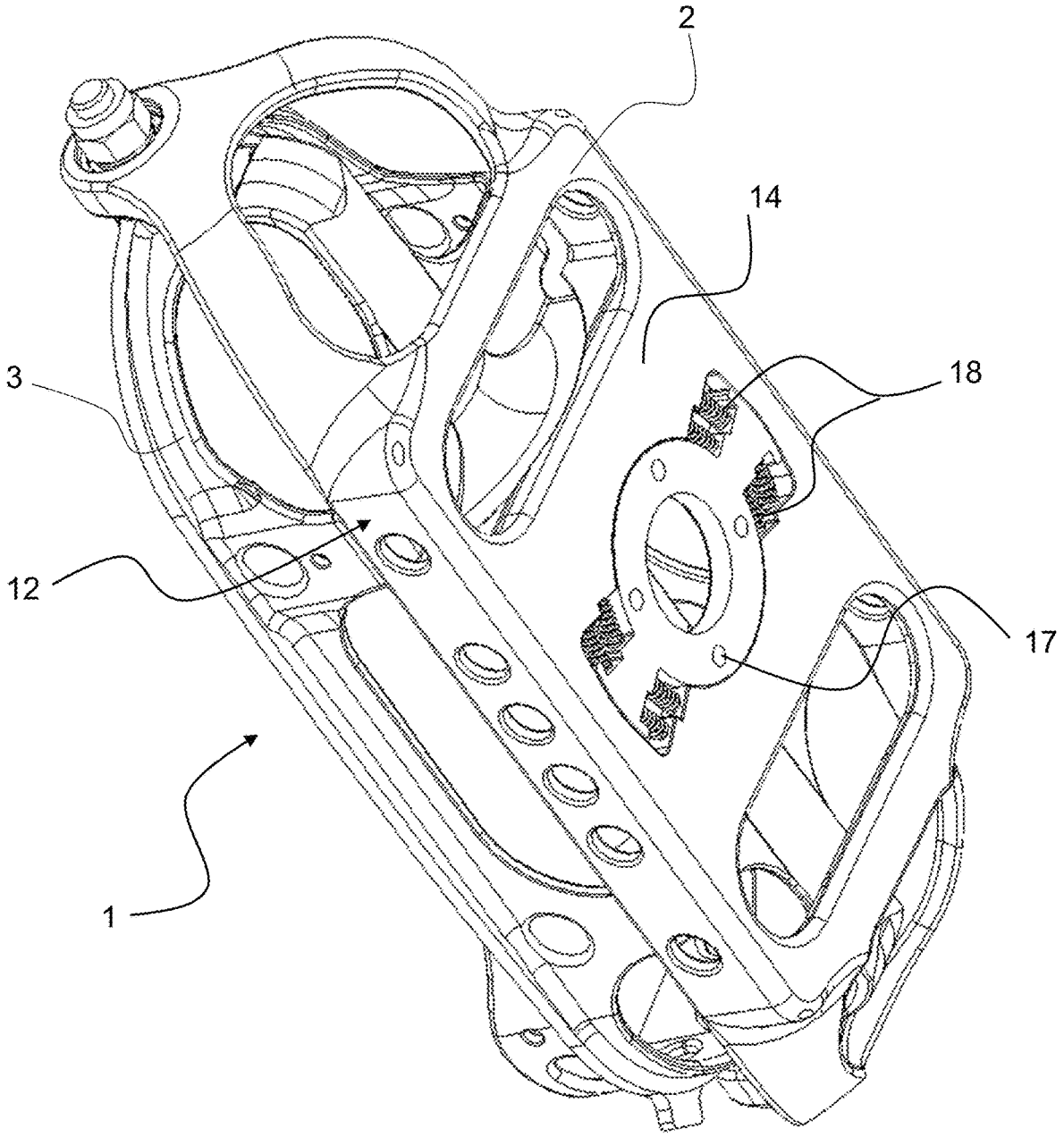
Figure 8:
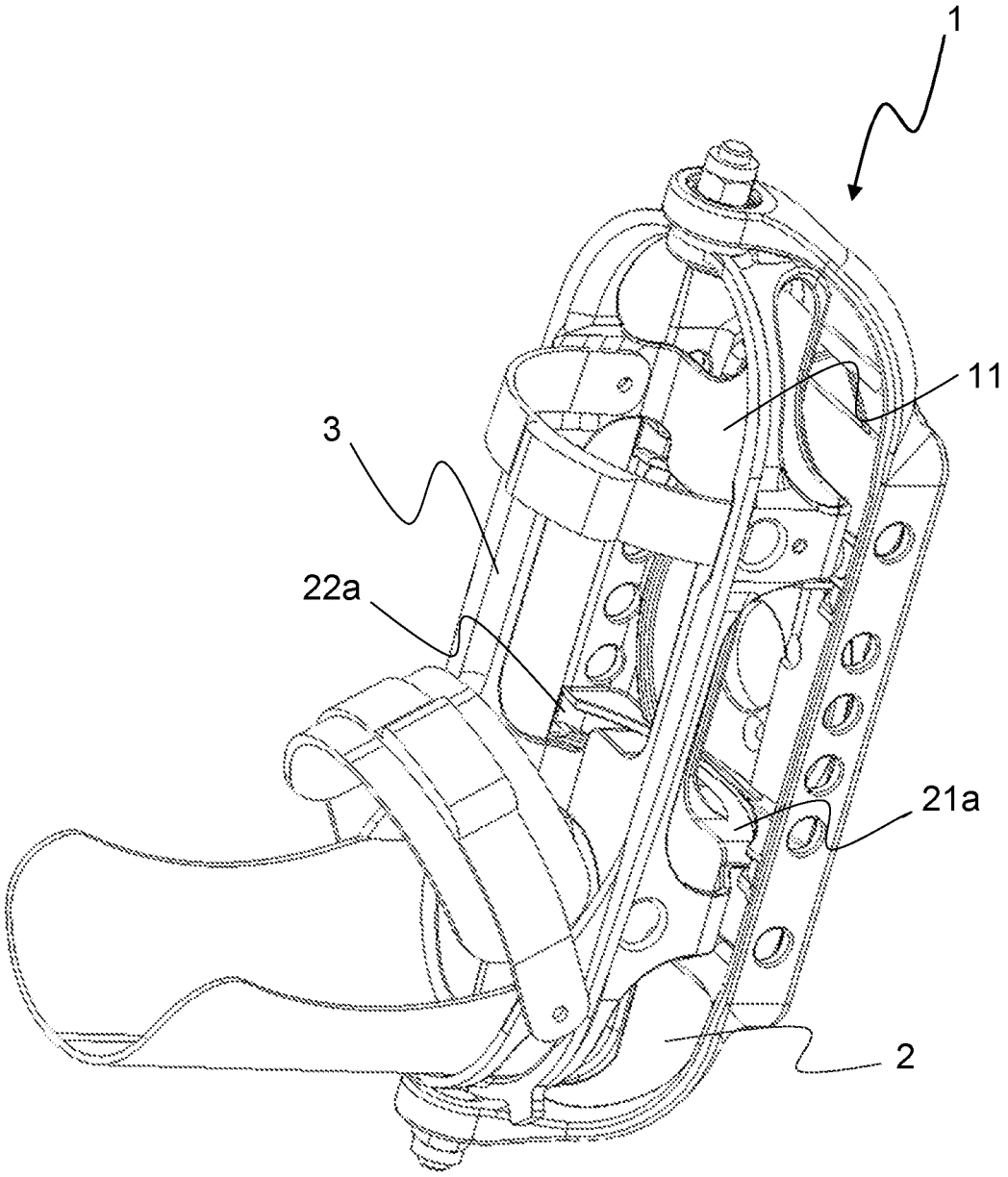
FIG. 8 is a schematic perspective view of a possible embodiment of the snowboard biding according to the present invention equipped with the binding straps and rear backing.
Figure 9:
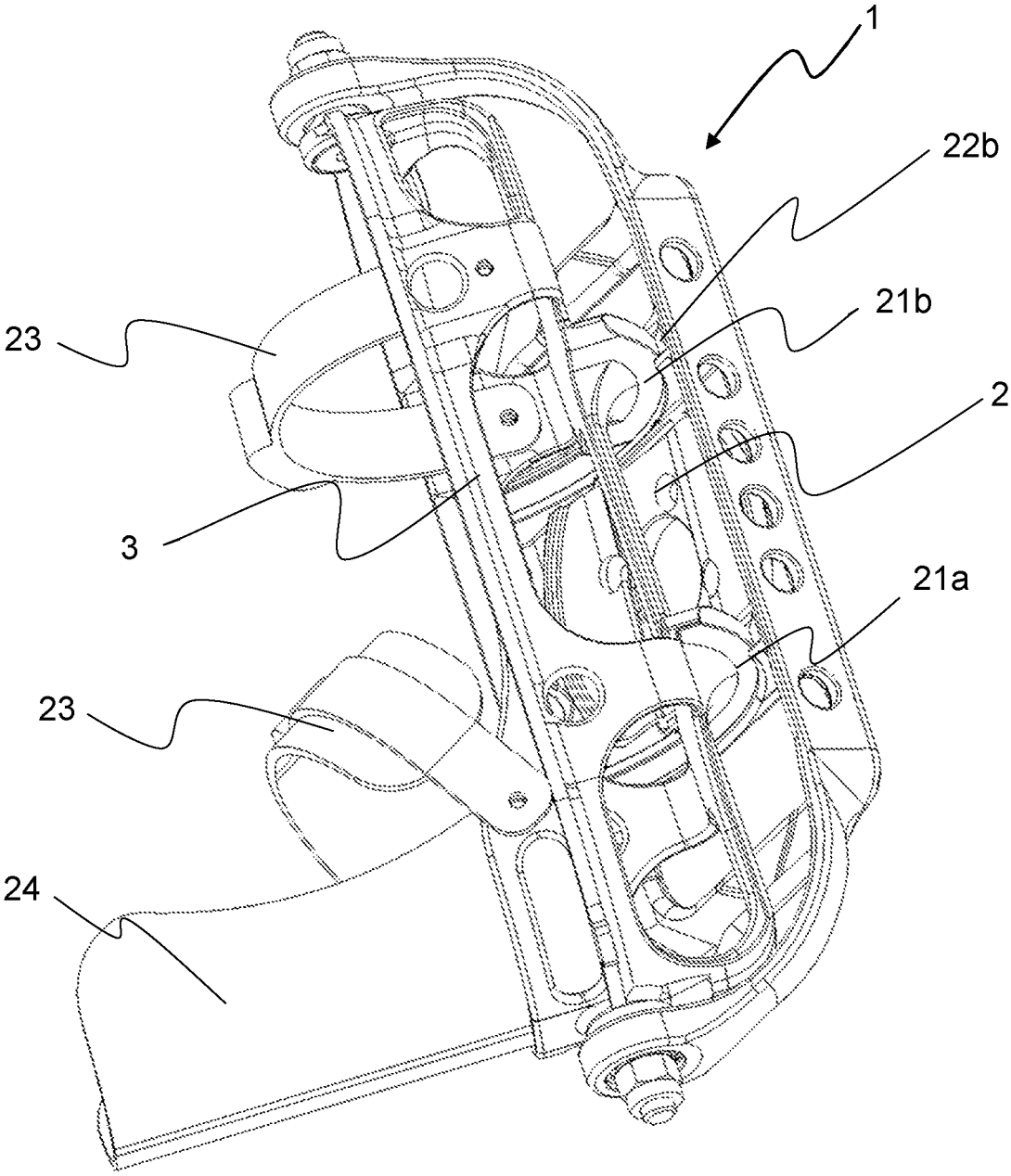
FIG. 9 is a schematic perspective view of a possible embodiment of the snowboard binding according to an aspect of the present invention showing the bottom plate of the boot anchor element equipped with the binding straps and rear backing.

The shaft is inserted into the respective through-holes formed on the front and rear portions (10, 12, 11, 13) of both the snowboard anchor element (2) and boot anchor element (3) and obtaining thereby two pivoting points, i.e., pivots (19, 20), one connecting the respective front portions (10, 12) and another connecting the respective rear portions (11, 13) of the snowboard anchor element (2) and boot anchor element (3) as shown in FIGS. 2 and 4. The shafts are fixed by nuts in the two pivoting points (19, 20).

The pivot axis (X) is preferably parallel but may be slightly inclined with respect to the bottom plate (14) of the snowboard anchor element (2). The inclination of the pivot axis with respect to the bottom plate of the snowboard anchor element may be up to 5° but is preferred to be less than 3°.

Since the snowboarder is supported by the pivoting boot anchor element (3), which is pivotally joined at its front and rear portions (10, 11) to the respective front and rear portions (12, 13) of the snowboard anchor element (2), the rotational freedom provided by the two rotational joints, i.e., pivots, allows the snowboarder to generate new flexibility that enhances the snowboarder's ability to achieve new body positions and perform new tricks. In addition, this pivoting arrangement of the snowboard binding of the present invention, thus providing a swivelling/tilting of the rider's foot, is less tiring and less stressful on the legs over a long day of riding as well as while sitting on ski lifts.

In the illustrated embodiment, both the snowboard anchor element (2) and the boot anchor element (3) have a substantially cage-like shape or are substantially shell-shaped. Accordingly, the snowboard and boot anchor elements (2, 3) have an open work structure having a hollow or concave shape.

FIGS. 2-5 show the snowboard binding (1) wherein the outer surface of the bottom plate (7) of the boot anchor element (3), which is facing toward the inner surface of the bottom plate (14) of the snowboard anchor element (2), is provided with two transversally protruding elements (21*a*, 21*b*) that can be engaged respectively with a sliding guide (22*a*, 22*b*) provided transversally on the inner surface of the bottom plate (14) of the snowboard anchor element (2). Advantageously, each of the sliding guides (22*a*, 22*b*) has a complementary shape with the respective protruding element (21*a*, 21*b*) and is arranged transversally on the inner surface of the bottom plate (14) of the snowboard anchor element (2) in a manner that each protruding element (21*a*, 21*b*) can slide in the respective sliding guide (22*a*, 22*b*) during pivoting of the boot anchor element (2) around the pivot axis (X).

According to the embodiment shown in FIGS. 1-9, the sliding guide (22*a*, 22*b*), formed on the inner surface of the bottom plate (14) of the snowboard anchor element (3), has the shape of a channel, i.e. it has a bottom wall and two side walls which form a cavity wherein the protruding element (21*a*, 21*b*) of the boot anchor element (2) can freely slide due to its complementary shape. Thereby the sliding guide (22*a*, 22*b*) controls the direction of the movement of the boot anchor element (2) with respect to the snowboard anchor element (3).

The snowboard binding of the present invention is mounted to the snowboard (not illustrated) by means of using mechanical fasteners, such as bolts, screws, etc. In detail, according to an embodiment, the snowboard anchor element (2) is fastened to the snowboard by means of an angle set plate (16) provided with holes or slots (17) through which screws or bolts are driven into the snowboard, as is standard practice.

According to an embodiment, as for example illustrated in the figures, the angle set plate (16) is connected to the bottom plate (14) of the snowboard anchor plate (2) by means of elastic elements (18), e.g., by springs. In the illustrated embodiment, FIGS. 1-9 show the snowboard binding wherein the angle set plate (16) is accommodated in the plane of the bottom plate (14) of the snowboard anchor element (2). This arrangement of the snowboard binding (1) of the present invention allows a limited rotation of the snowboard binding (1) about a vertical axis passing through the centre point of the angle set plate (16). This kind of rotation of the snowboard binding also contributes to further enhancement of the snowboarder's comfort during riding.

Advantageously, in order to better exploit the above-said rotation of the snowboard anchor plate (2), the vertical axis of the angle set plate (16) may pass through the middle of the rider's foot accommodated in the boot anchor element (3).

FIGS. 1-7 illustrate some connecting apertures (8, 9) on the boot anchor element (3), particularly on the heel holder (5) and on the side walls (6). These apertures serve for inserting fastening means or binding straps (23) for the boot and rear backing (24) into the boot anchor element (3) as for example shown in FIGS. 8 and 9. Any fastening means can be used in addition or in place of binding straps, such as binding, laces, clips, etc.

A further embodiment is illustrated for example in FIGS. 10-16, wherein the snowboard binding comprises one pivot (20) and two sliding guides (21*a*, 22*b*) operating as pivot mechanisms.

Said one pivot (20) passes through at least one hole formed on the rear portion (13) of the snowboard anchor element (2) and on the rear portion (11) of the boot anchor element (3) to allow a pivot coupling between the boot anchor element (3) and the snowboard anchor element (2).

Said sliding guides (21*a*, 21*b*) are provided transversally on the inner surface of the bottom plate (14) of the snowboard anchor element (2). Each of said sliding guides cooperates with a corresponding element (22*a*, 22*b*) transversally protruding from the outer surface of the bottom plate (7) of the boot anchor element (3) in order to allow lateral sliding movement, along a curved surface (thus providing a pivot couplings about the pivot axis X) of the boot anchor element (3) over the snowboard anchor element (2).

In the embodiment represented in FIGS. 10-16 one of said two guides (22*a*) is arranged on the rear portion (13) of the inner surface of the bottom wall (14) of the snowboard anchor element (2) and, accordingly, the corresponding element (21*a*) transversally protruding from the outer surface of the bottom wall (7) of the boot anchor element (3) is located at the rear portion (11) of said boot anchor element (3) in a manner that said transversally protruding element (21*a*) of the boot anchor element (3) is allowed to slide in said sliding guide (22*a*) and provide thereby a pivoting movement of the snowboard binding around the pivot axis (X).

Figure 13:
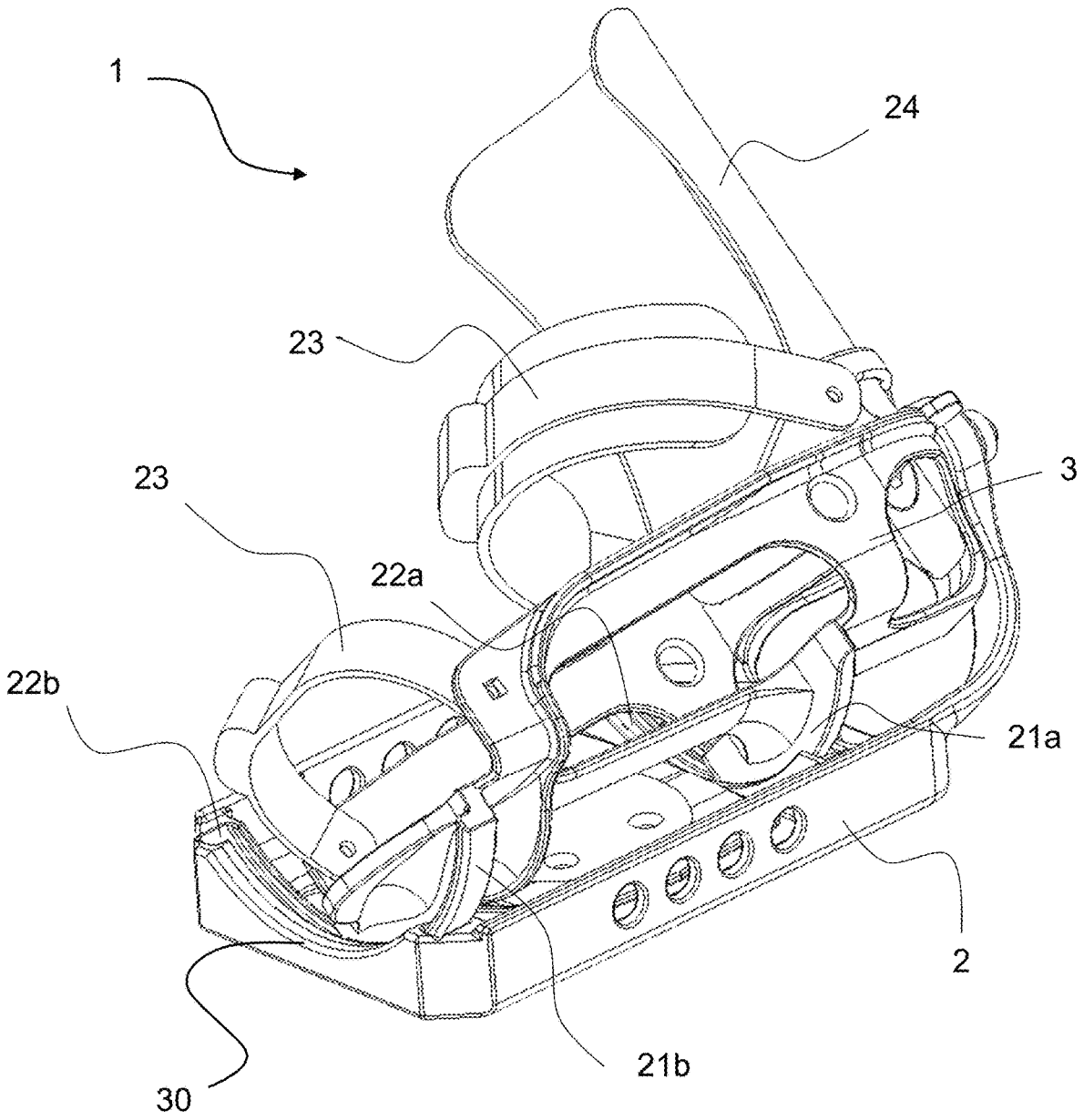
FIG. 13 shows the snowboard binding shown in FIG. 10 illustrating a cooperation of the element transversally protruding from the outer surface of the bottom plate of the boot anchor element with the corresponding sliding guides of the snowboard anchor element.
Figure 14:
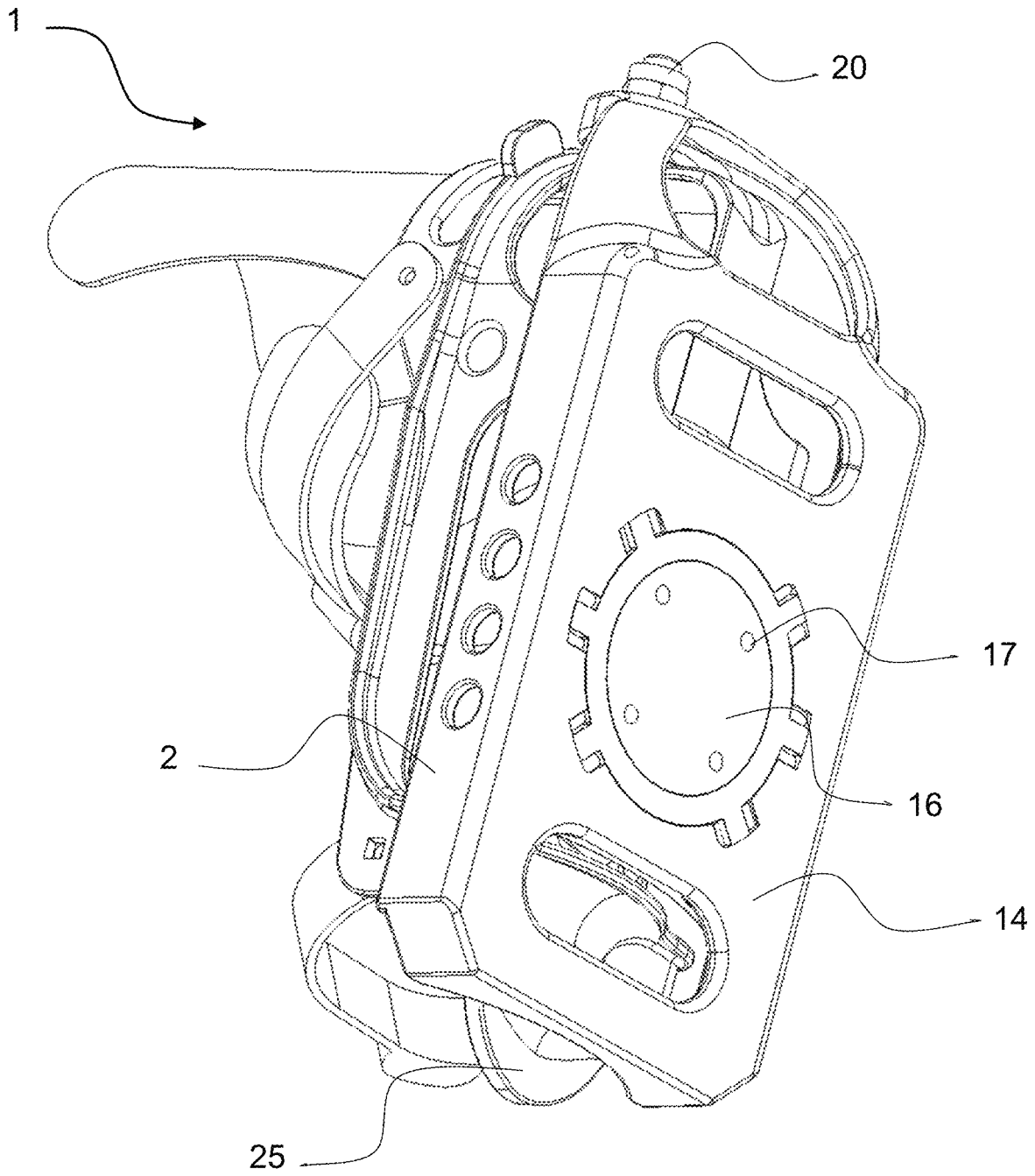
FIG. 14 is a partial bottom view of the snowboard binding shown in FIG. 10 exposing the outer surface of the bottom plate of the snowboard anchor element.
Figure 15:
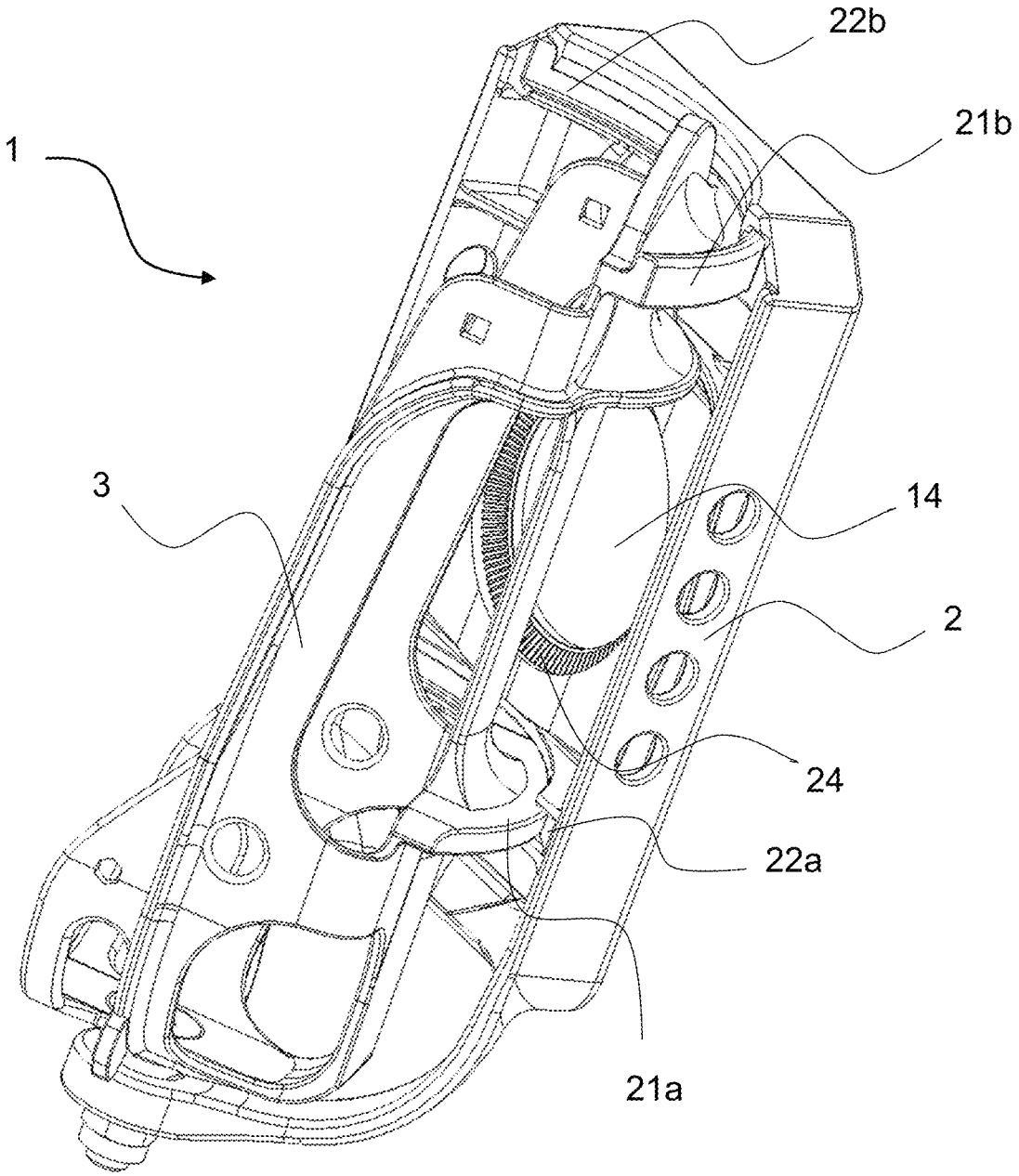
FIG. 15 shows the snowboard binding shown in FIG. 10 without the binding straps and rear backing wherein the boot anchor element is inclined to show the inner surface of the bottom plate of the snowboard anchor element.
Figure 16:
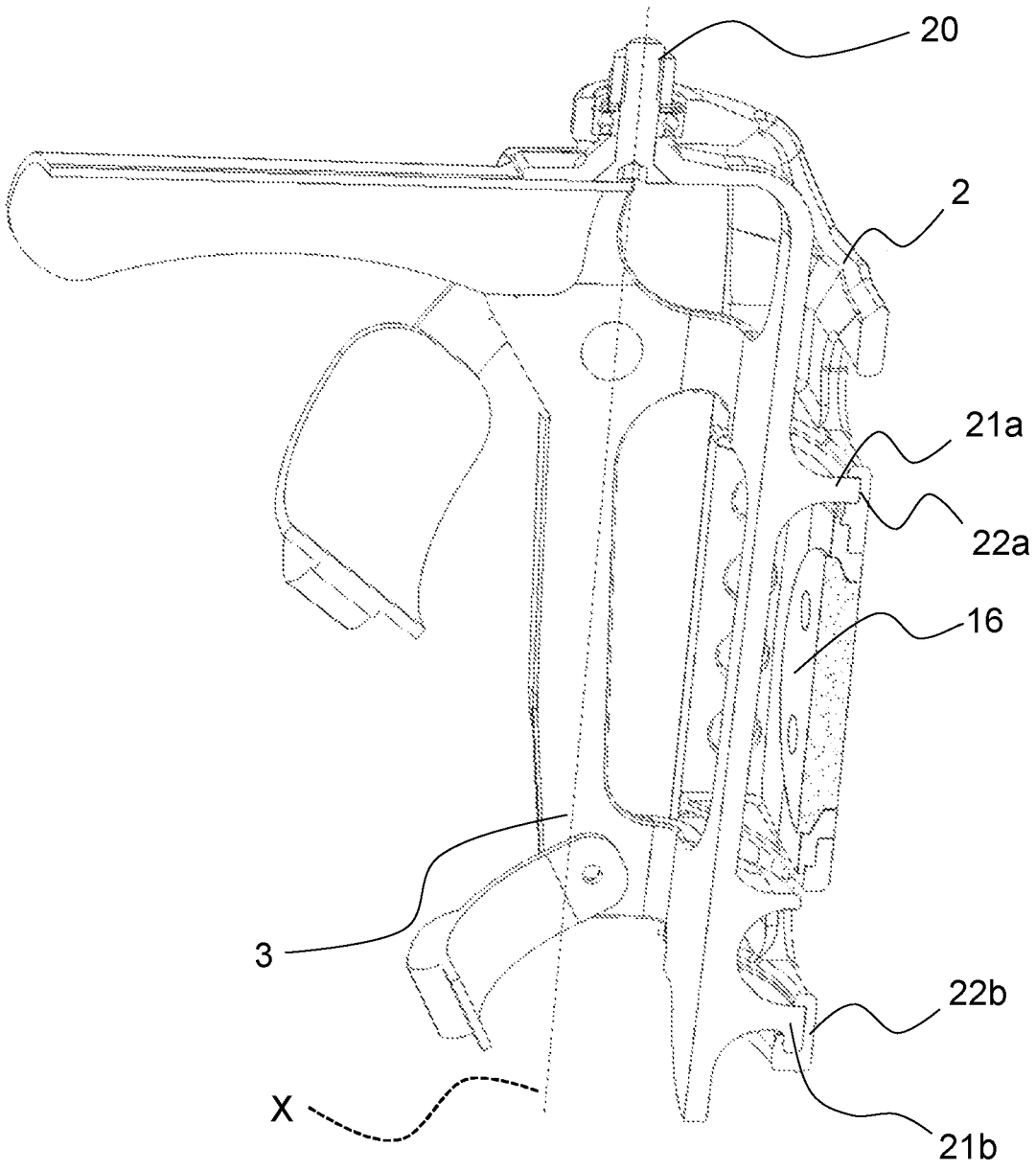
FIG. 16 is a perspective cross-sectional view of the snowboard binding shown in FIG. 10.

As shown in FIGS. 13 and 15, according to an embodiment, the other sliding guide (22*b*) is provided at the front portion (12) of the inner surface of the bottom plate (14) of the snowboard anchor element (2) and, accordingly, the corresponding elements (21*b*) transversally protruding from the outer surface of the bottom plate (7) of the boot anchor element (3) are located at the front portion (10) of the boot anchor element (3). Analogously to the transversally protruding element (22*a*), also the other transversally protruding element (21*b*) is arranged in such a manner to be able to cooperate with the corresponding sliding guide (22*b*) and to provide a pivoting movement to the snowboard binding around the pivot axis (X).

Each of said protruding elements (21*a*, 21*b*) has a shape complementary to the shape of the corresponding sliding guide (22*a*, 22*b*).

FIGS. 10, 13, 14 and 16 show the snowboard binding according to said further embodiment, which is equipped with binding straps (23) and rear backing (24).

Figure 10:
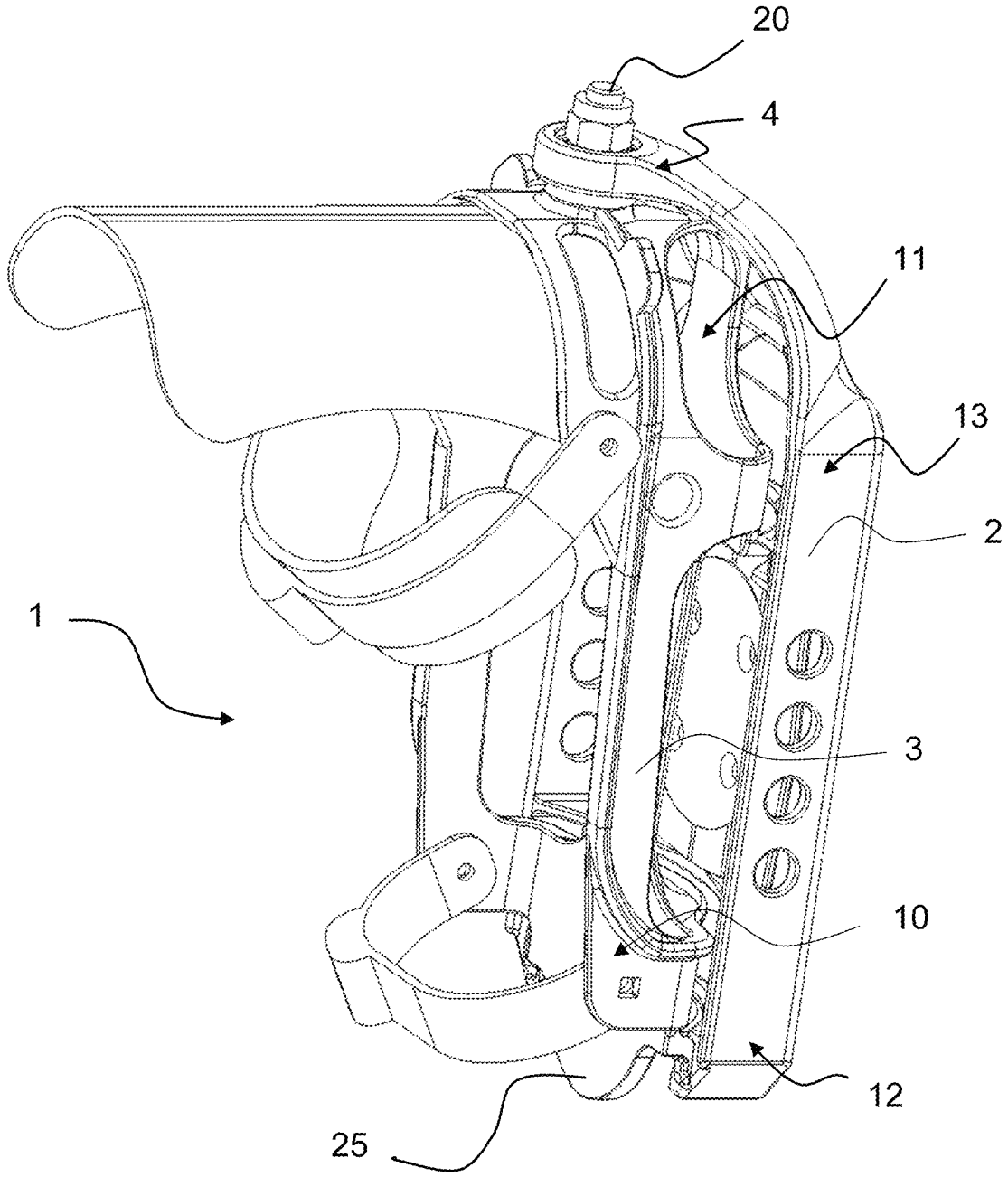
FIG. 10 is a schematic perspective view of a further possible embodiment of the snowboard binding according to the present invention showing a snowboard binding equipped with binding straps and rear backing and having open extremities at the respective front portions of the boot anchor element and the snowboard anchor element.
Figure 11:
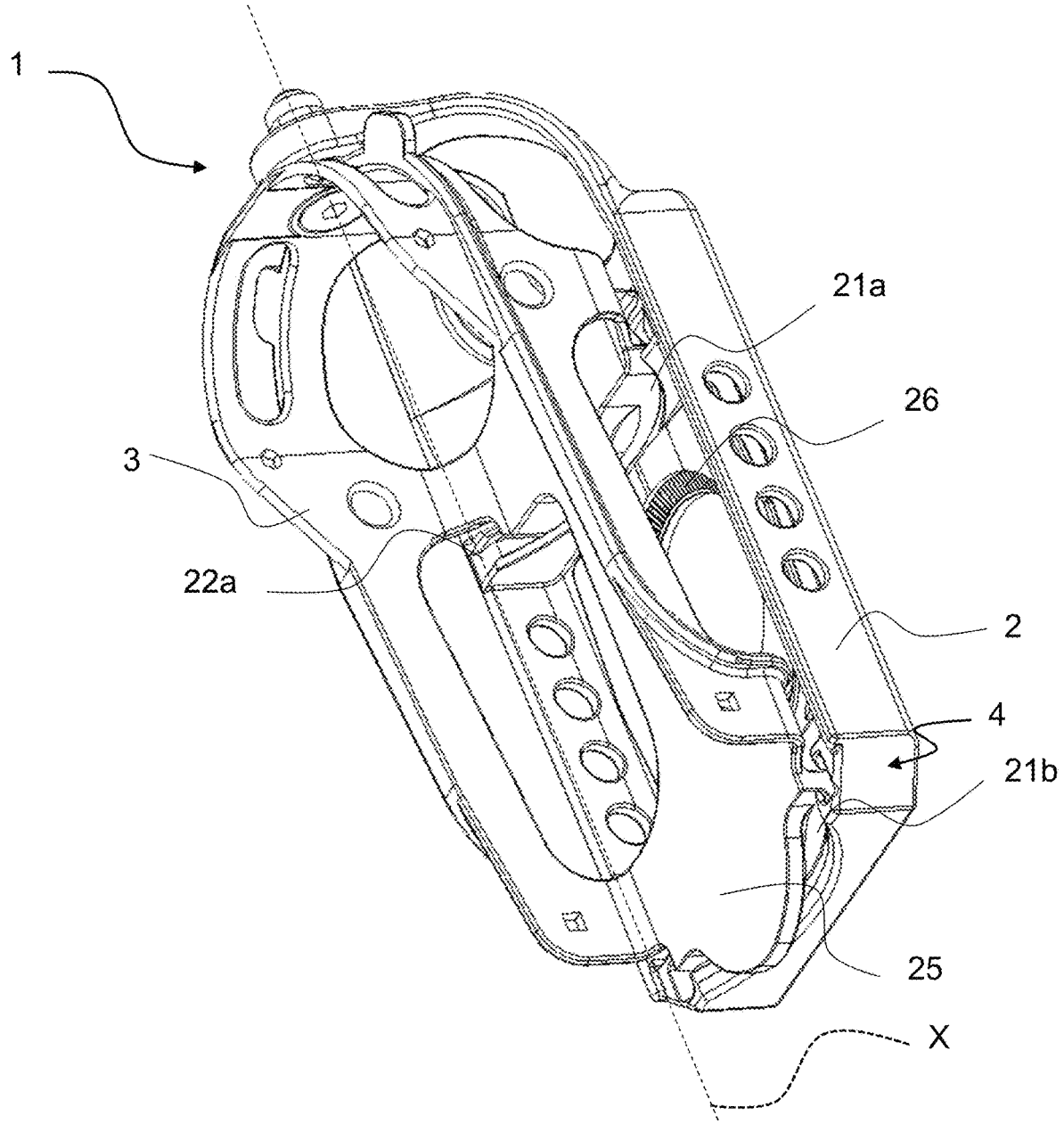
FIGS. 11 and 12 are a partial top view of the snowboard binding shown in FIG. 10 without the binding straps and rear backing.
Figure 12:
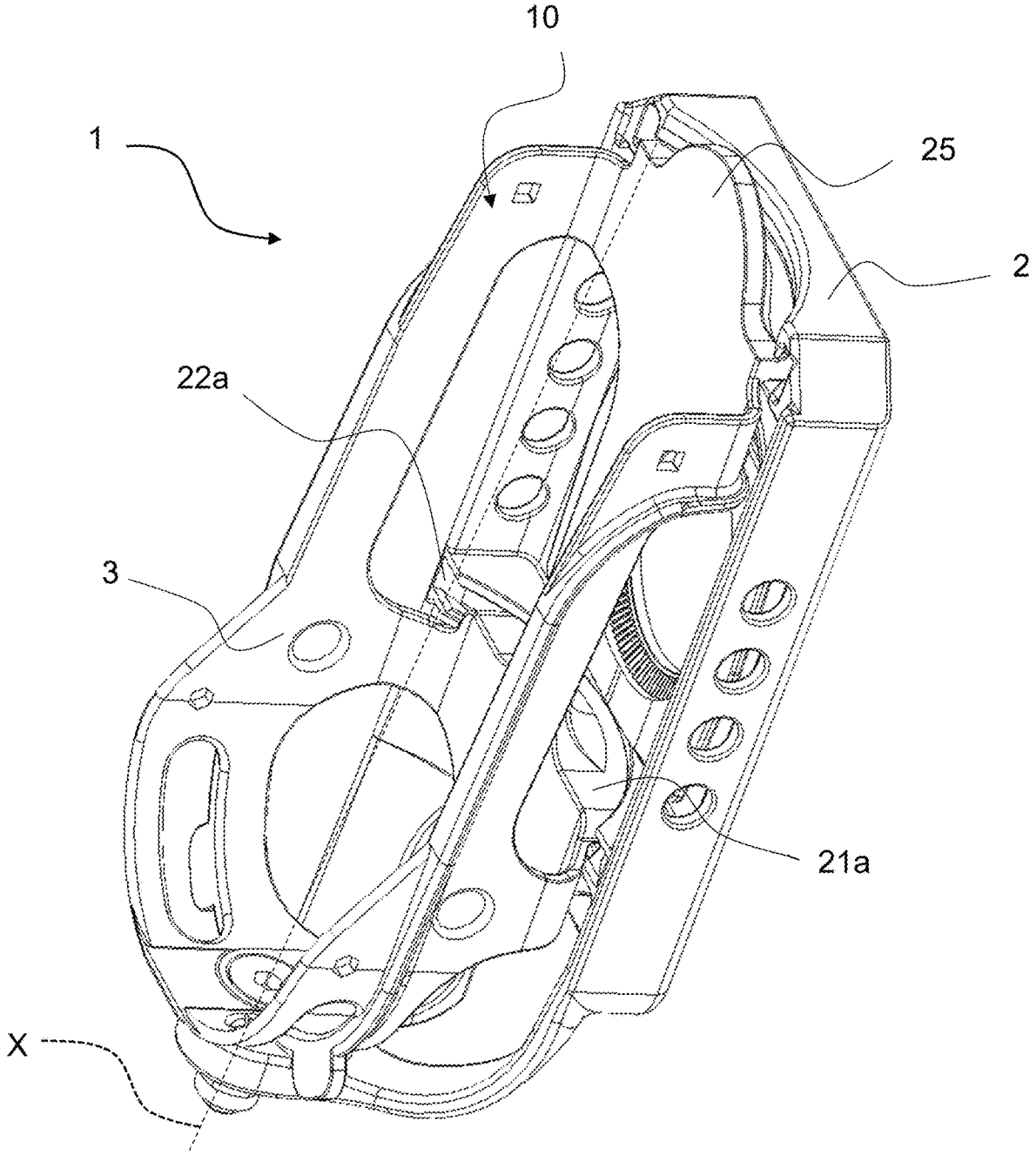

FIGS. 11 and 12 show a partial top view of the snowboard binding of FIG. 10 without binding straps (23) and rear backing (24), wherein the internal surface of the bottom plate of the boot anchor element (3) is exposed. FIGS. 11 and 12 show that the substantially cage-like shape or substantially shell shape of both the snowboard anchor element (2) and the boot anchor element (3) is open at their front portions (10, 12) where the sliding guide (21*b*) is located. This "open" shape of the front portion (25, 30) of the bottom plate (7, 14) of both the boot anchor element (3) and the snowboard anchor element (2) allows to adapt the snowboard binding to different sizes of boots.

Furthermore, FIGS. 11, 12 and 15 show the internal surface of the bottom plate (14) of the snowboard anchor element (2) of the binding according to this further embodiment, wherein the bottom plate (14) of the snowboard anchor element (2) is provided with an angle set plate (16) which is connected to the snowboard anchor element (2) by means of an elastomer material.

A further aspect of the present invention is a snowboard (26) which is particularly suitable for the snowboard binding of the present invention in order to further improve fun and entertainment of the rider.

Figure 17:
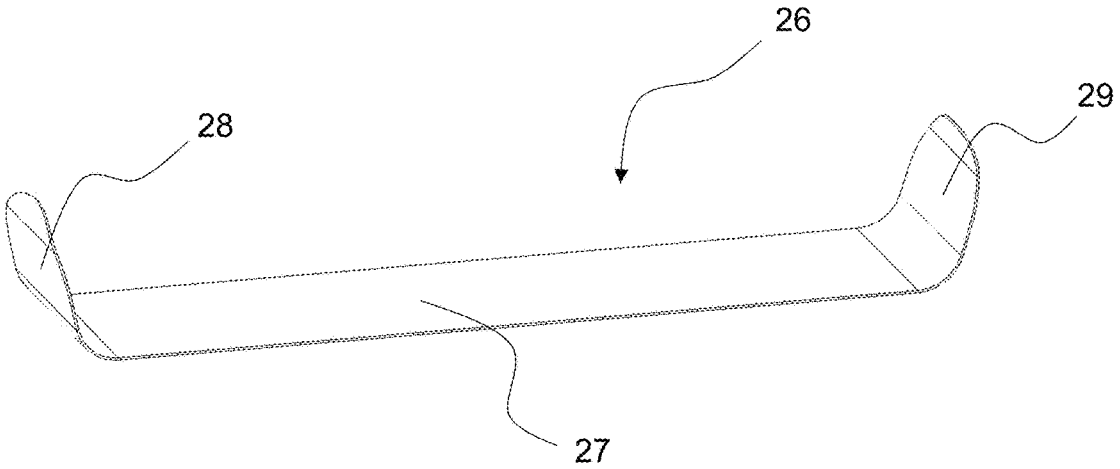
FIGS. 17 and 18 are schematic views of the snowboard of the present invention.

The snowboard (26) of the present invention is shown in a perspective view in FIG. 17 and has a longitudinal shape with a length and width such to allow the fixing of a pair of said snowboard binding, preferably snowboard binding of the present invention, on its longitudinal upper surface (27).

Figure 18:
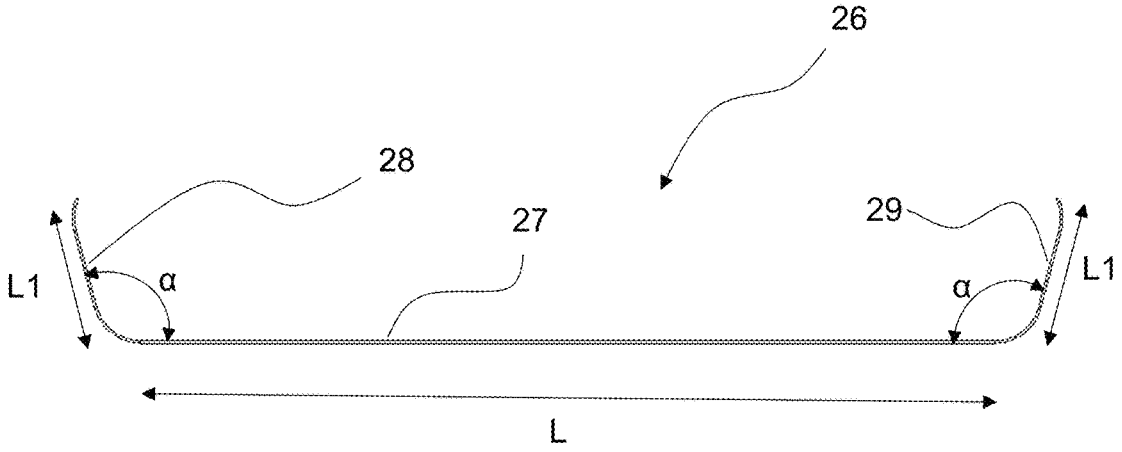

Said longitudinal upper surface (27) of the snowboard (26) terminates in a tip (28) and a tail (29), which are upwards bent at an angle $\alpha$ comprised between 30° and 80° with respect to said upper longitudinal surface (27) of the snowboard (26). FIG. 18 shows the high grade of bending of the tip and tail with respect to the upper surface of the snowboard.

It has to be noted that the wording "longitudinal upper surface terminates in a tip (28) and/or a tail (29)" is used herein to indicate that the snowboard base comprises a tip and/or a tail that can be made in one piece with the snowboard base or can be a separate portion that is constrained to the snowboard base.

As already mentioned above, it is possible for only the tip or only the tail to be bent upwards, while the other side may resemble a traditional snowboard.

In particular, it has to be noted that even if in FIG. 17-18 a snowboard having both a bent tip (28) and a bent tail (29) is shown, according to the invention are also possible embodiments wherein the snowboard has only a bent tip and only a bent tail having bending angle and lengths disclosed herein.

With the tilting of the binding and the bent sections on the tip and tail of the board, the rider is able to ride stably on the tip or tail of the board while the board is at extreme angles (more than 30°) respect to the ground.

Figure 19:
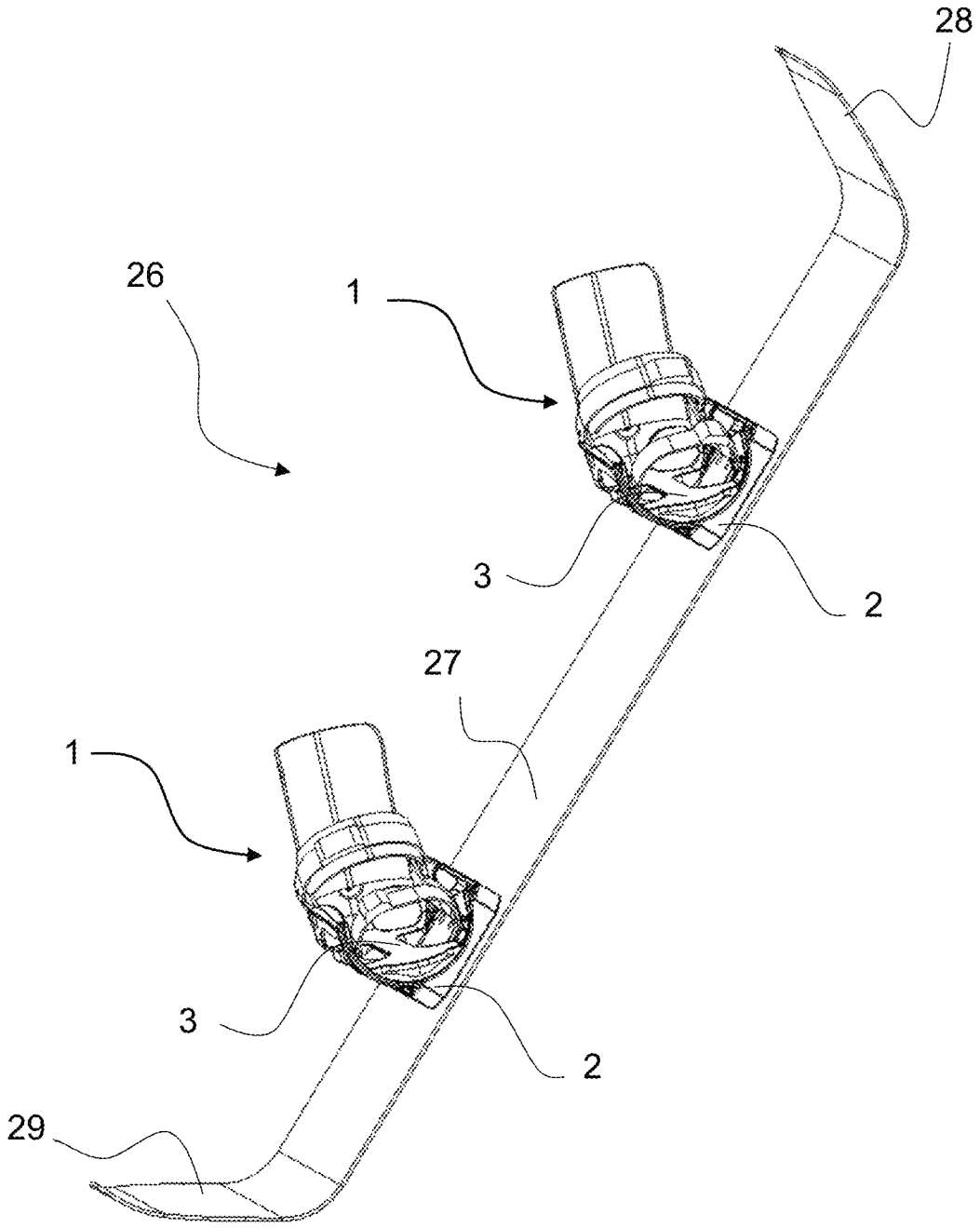
FIG. 19 shows the binding according to the invention and the snowboard according to the invention in a possible stable riding position.

FIG. 19 shows the binding according to the invention and the snowboard according to the invention in a possible use position wherein the rider is able to ride stably on the tail (29) of the board. Also FIG. 20 shows a rider using the binding according to the invention and the snowboard according to the invention having only a bent tail 29 according to the invention and a standard tip in a possible ride position wherein the rider is able to ride stably on the tail (29) of the board.

In view of above, the snowboard according to the invention, preferably combined with the binding according to the invention, allows to reach riding positions that cannot be reach with known snowboard.

Figure 20:
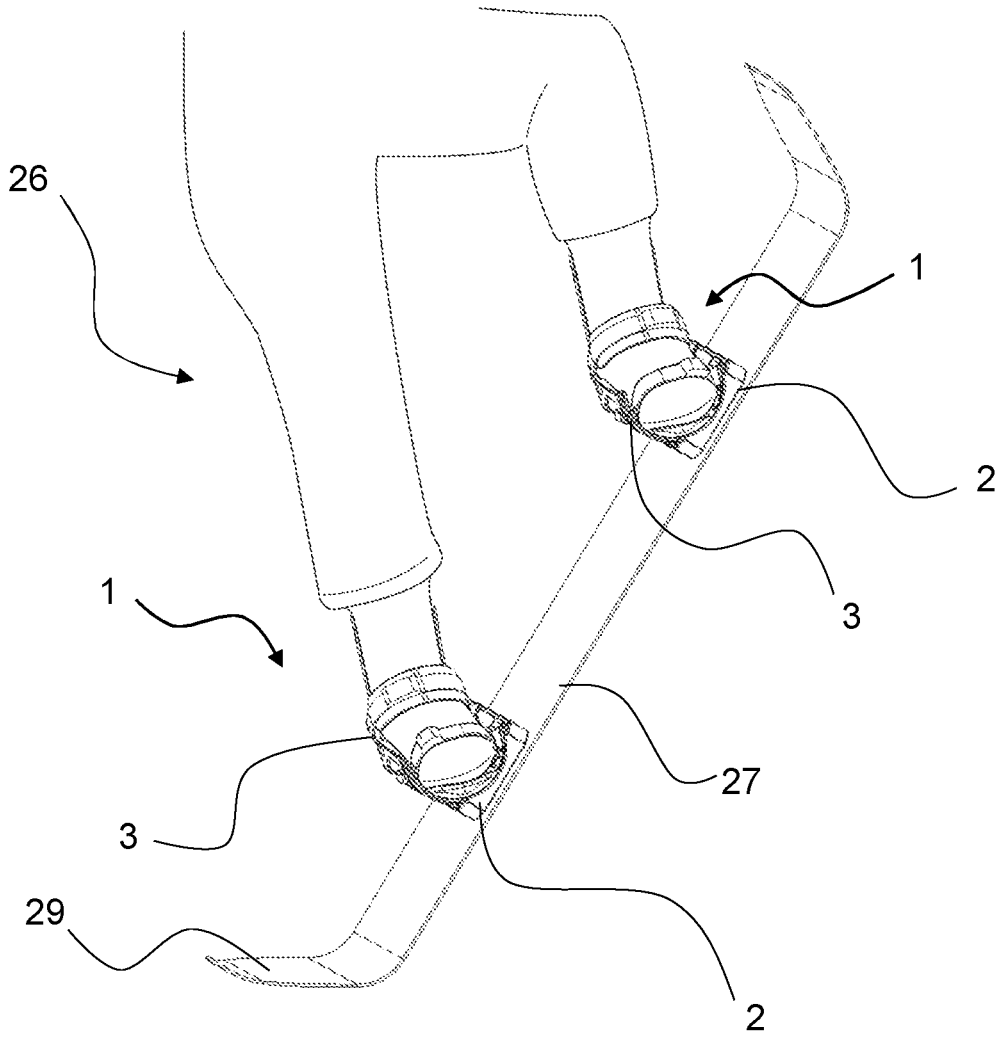
FIG. 20 shows a rider using the binding according to the invention and the snowboard according to the invention in a possible stable riding position.

For example, with standard snow board it is not possible to reach riding position, as the one shown in FIG. 19 and in FIG. 20, wherein the snowboard is stably riding on the bent tail portion while the board is at extreme angles (more than 30°) respect to the ground.

Additionally, the combination with the binding according to the invention also allows that in the riding position on the tail or on the tip of the snowboard the bottom of the rider's foot reduce their inclination with respect to the ground (e.g. they can be arranged parallel or closely parallel with respect to the ground) due to the pivot (rotation) of the boot anchor portion with respect to the snowboard anchor element about the pivot (rotation axis) X of the binding.

The ratio between the length L1 of each of said bent tip (28) and bent tail (29) with respect to the entire length (L) of the snowboard (26), that is corresponding to the length of the flat portion of the snowboard base, is comprised between 1/20 and 1/3. The advantages of the bindings described herein are numerous. The tilting action provided by the snowboard binding introduces a wide range of flexibility that enhances comfort of the rider during riding as well as while sitting on the ski lift. The flexibility allows also for a greater range of snowboarding tricks.

According to different possible embodiments of the invention, the bent tip (28) and/or the bent tail (29) has a flat portion but it may also comprise a continual curve and in general a curved surface. In the case of a curve, or curved shape, the length L1 of the bent tip and/or bent tail portion is measured by a straight line (laying on a longitudinal cross-section plane of the snowboard), the straight line extending between the two extremities of the bent tail and the bent tip, (i.e. extending between the end of the snowboard flat base from which the tail and/or the tip is extending and the end of the bent tail and/or the bent tip).

The binding for snowboard according to the present invention has standardised mounting system, therefore, it is compatible with the majority of boards. However, it may also be adapted to attach to boards with other mounting systems. Furthermore, the binding of the present invention does not require specific boots to ride.

The invention claimed is:

1. A snowboard binding (1) comprising:

a snowboard anchor element (2) and a boot anchor element (3);

at least one pivot mechanism (4) pivotally coupling the snowboard anchor element (2) and the boot anchor element (3) to allow pivoting of the boot anchor element (3) with respect to the snowboard anchor element (2), wherein the at least one pivot mechanism comprises a pivot axis (X) allowing rotation of the boot anchor element (3) with respect to the snowboard anchor element (2) and the pivot axis (X) is arranged within the width of the binding.

2. The snowboard binding of claim 1, wherein said at least one pivot mechanism comprises at least one pivot (19, 20) and/or at least one sliding guide (22*a*, 22*b*).

3. The snowboard binding of claim 2, wherein said at least one sliding guide (22*a*, 22*b*) has a complementary shape with at least one protruding element (21*a*, 21*b*).

4. The snowboard binding of claim 1, wherein said at least one pivot mechanism pivotally couples the snowboard anchor element (2) and the boot anchor element (3) at their respective front (10, 12) and/or rear portions (11, 13).

5. The snowboard binding of claim 1, wherein the pivot axis (X) is arranged at a distance from a bottom plate (14) of the snowboard anchor element (2).

6. The snowboard binding of claim 1, wherein the pivot axis (X) is arranged close to the rider's ankle height and along the direction of the rider's foot.

7. The snowboard binding of claim 1, wherein the pivot axis (X) is parallel or slightly inclined with respect to the bottom of the binding, the pivot axis (X) is parallel or slightly inclined with respect to the bottom plate (14) of the snowboard anchor element (2), in the direction the foot is pointing.

8. The snowboard binding of claim 1, wherein the pivot axis (X) passes through the front and/or rear portions (10, 11; 12, 13) of at least one of, or both, the snowboard anchor element (2) and the boot anchor element (3).

9. The snowboard binding of claim 1, wherein the at least one pivot mechanism comprises at least one pivot (19) arranged substantially at the front portion (12) of the snowboard anchor element, said pivot passing through at least one hole formed on the front portion (12) of the snowboard anchor element (2), and/or at least one pivot (20) arranged substantially at the rear portion (13) of the snowboard anchor element, said pivot passing through at least one hole formed on the rear portion (13) of the of the snowboard anchor element (2).

10. The snowboard binding of claim 1, wherein the at least one pivot mechanism comprises at least a pivot (19) arranged substantially at the front portion (10) of the boot anchor element (3), said pivot passing through at least one hole formed on the front portion (10) of the boot anchor element (3) and/or at least a pivot (20) arranged substantially at the rear portion (11) of the boot anchor element (3), said pivot passing through at least one hole formed on the rear portion (11) of the boot anchor element (3).

11. The snowboard binding of claim 1, wherein said at least one pivot mechanism comprises one pivot (20) and at least one sliding guide (22*b*).

12. The snowboard binding of claim 11, wherein said one pivot (20) is arranged substantially at the rear portion (13) of the snowboard anchor element (2), said pivot passes through at least one hole formed on the rear portion (13) of the snowboard anchor element (2), and said at least one sliding guide (22*b*) interacts with an at least one protruding element (21*b*), transversally protruding from the outer surface of the bottom plate (7) of the boot anchor element (3), to allow a pivot coupling between the boot anchor element (3) and the snowboard anchor element (2).

13. The snowboard binding of claim 1, wherein the pivot axis (X) is arranged within the width of the rider's foot.

14. The snowboard binding of claim 1, wherein said at least one pivot mechanism comprises at least two pivots (19, 20) suspending the boot anchor element (2) at its front and, respectively, rear portions (10, 11) with respect to the snowboard anchor element (3).

15. A snowboard (26) for attaching a binding, characterised by being formed as a board having a shape with a length and width such to allow the fixing of a pair of said binding on its upper surface (27) wherein said upper surface and a lower surface of the snowboard terminate in a tip (28) and/or a tail (29), said tip (28) and/or said tail (29) being bent upwards at an angle (a) comprised between 30° and 80° with respect to the upper surface (27) of the snowboard, wherein said bent tip or tail allows a rider to stably ride on said bent tip or tail while the board is at angles more than 30° with respect to a ground.

16. The snowboard of claim 15, wherein the length (L1) of said bent tip (28) and/or said bent tail (29) is comprised between 50 mm and 800 mm.

17. The snowboard of claim 15, wherein the ratio between length (L1) of each of said bent tip (28) and/or of said bent tail (29) with respect to the entire length (L) of the snowboard base (26) is comprised between 1/20th and 1/3.

18. The snowboard of claim 15 for attaching a binding comprising a snowboard anchor element (2) and a boot anchor element (3), and at least one pivot mechanism (4) pivotally coupling the snowboard anchor element (2) and the boot anchor element (3) to allow pivoting of the boot anchor element (3) with respect to the snowboard anchor element (2).

19. The snowboard of claim 15, including the snowboard binding of claim 1.

* * * * *